US008947311B2

(12) United States Patent
Yoshino et al.

(10) Patent No.: US 8,947,311 B2
(45) Date of Patent: Feb. 3, 2015

(54) ANTENNA

(75) Inventors: Yoshitaka Yoshino, Tokyo (JP); Satoru Tsuboi, Kanagawa (JP); Tadashi Imai, Chiba (JP); Akira Ishizuka, Tochigi (JP)

(73) Assignee: Sony Corporation, Tokyo (JP)

( * ) Notice: Subject to any disclaimer, the term of this patent is extended or adjusted under 35 U.S.C. 154(b) by 375 days.

(21) Appl. No.: 13/501,046

(22) PCT Filed: Oct. 12, 2010

(86) PCT No.: PCT/JP2010/067865

§ 371 (c)(1),
(2), (4) Date: May 3, 2012

(87) PCT Pub. No.: WO2011/046112

PCT Pub. Date: Apr. 21, 2011

(65) Prior Publication Data

US 2012/0274529 A1 Nov. 1, 2012

(30) Foreign Application Priority Data

Oct. 13, 2009 (JP) ..... 2009-236406
Sep. 21, 2010 (JP) ..... 2010-210856

(51) Int. Cl.

| | |
|---|---|
| ***H01Q 9/04*** | (2006.01) |
| ***H01Q 1/24*** | (2006.01) |
| ***H01Q 9/26*** | (2006.01) |
| ***H01Q 5/00*** | (2006.01) |
| ***H01Q 9/16*** | (2006.01) |

(52) U.S. Cl.

CPC ..... *H01Q 9/16* (2013.01); *H01Q 1/243* (2013.01); *H01Q 9/26* (2013.01); *H01Q 5/0051* (2013.01)

USPC ..... 343/791; 343/790

(58) Field of Classification Search

USPC ..... 343/790, 791, 792

See application file for complete search history.

(56) References Cited

U.S. PATENT DOCUMENTS 6,337,663 B1 * 1/2002 Chi-Ming ..... 343/702
6,504,511 B2 * 1/2003 Andersson ..... 343/702

(Continued)

FOREIGN PATENT DOCUMENTS

EP 1 845 582 10/2007
GB 690113 4/1953

(Continued)

OTHER PUBLICATIONS

Extended European Search Report dated Jul. 23, 2013 in corresponding European Patent Application No. 10823380.0.

(Continued)

*Primary Examiner* — Hoanganh Le
(74) *Attorney, Agent, or Firm* — K&L Gates LLP

(57) ABSTRACT

An antenna is realized by a simple mechanism without use of a dedicated antenna element. An antenna includes a first conductor 2*b* (2*d*) that has a first line length from a start point 4 to a folded point 3; and a second conductor 2*b* (2*d*) that has a second line length in a direction from the folded point 3 to the start point 4 and is electrically connected to the first conductor at the folded point 3. A first received signal with a first frequency is received with a first antenna length including both the first line length and the second line length. A second received signal with a second frequency is received with a second antenna length including only one of the first line length and the second line length.

8 Claims, 31 Drawing Sheets

EXAMPLE OF CONFIGURATION OF CABLE ANTENNA

(56) References Cited

U.S. PATENT DOCUMENTS

| | | | | |
|---|---|---|---|---|
| 6,535,170 | B2 * | 3/2003 | Sawamura et al. | 343/702 |
| 2006/0082506 | A1 | 4/2006 | Fang | |
| 2009/0167614 | A1 | 7/2009 | Takaki et al. | |

FOREIGN PATENT DOCUMENTS

| | | |
|---|---|---|
| JP | 61-046601 | 3/1986 |
| JP | 10-056315 | 2/1998 |
| JP | 2004-128740 | 4/2004 |
| JP | 2004328364 | 11/2004 |
| JP | 3938211 | 6/2007 |
| JP | 2008-199204 | 8/2008 |
| JP | 2008-228257 | 9/2008 |
| JP | 2009-055299 | 3/2009 |
| JP | 2009-153076 | 7/2009 |
| WO | 2007/141910 | 12/2007 |

OTHER PUBLICATIONS

Japanese Office Action issued Feb. 4, 2014 in corresponding Japanese Patent Application No. 2012095720.

* cited by examiner

DIAGRAM FOR PRINCIPLE OF CABLE ANTENNA

EXAMPLE OF DESIGN OF CABLE ANTENNA WHEN TWO ARBITRARY FREQUENCIES (WITH WAVELENGTHS λ1 AND λ2) ARE RECEIVED

EQUIVALENT CIRCUIT DIAGRAM OF CABLE ANTENNA WHEN RESONANCE OCCURS WITH SECOND FREQUENCY

EQUIVALENT CIRCUIT DIAGRAM OF CABLE ANTENNA WHEN RESONANCE OCCURS WITH FIRST FREQUENCY

EXAMPLE OF CONFIGURATION OF CABLE ANTENNA ACCORDING TO FIRST EMBODIMENT

EXAMPLE OF CONFIGURATION OF CABLE ANTENNA IN CASE OF HALF FIRST LINE LENGTH

| | VERTICALLY POLARIZED WAVE | | | | | | | |
|---|---|---|---|---|---|---|---|---|
| FREQUENCY (MHz) | 76 | 78.5 | 81 | 83.5 | 86 | 95 | 101 | 107 |
| PEAK GAIN (dBd) | −13.60 | −13.77 | −13.61 | −12.93 | −11.90 | −6.85 | −3.53 | −3.36 |

| | HORIZONTALLY POLARIZED WAVE | | | | | | | |
|---|---|---|---|---|---|---|---|---|
| FREQUENCY (MHz) | 76 | 78.5 | 81 | 83.5 | 86 | 95 | 101 | 107 |
| PEAK GAIN (dBd) | −17.80 | −18.00 | −17.83 | −17.53 | −16.70 | −13.05 | −11.00 | −12.48 |

MEASUREMENT RESULT OF PEAK GAIN IN FM/VHF BAND

EXAMPLE OF CONFIGURATION OF CABLE ANTENNA ACCORDING TO SECOND EMBODIMENT

| MEASUREMENT POINT | FREQUENCY (MHz) | VSWR |
|---|---|---|
| MK1(▲) | 76.000 | 4.01 |
| MK2(△) | 80.000 | 2.33 |
| MK3(●) | 85.000 | 2.80 |
| MK4(○) | 90.000 | 6.10 |
| MK5(■) | 470.000 | 3.16 |
| MK6(□) | 570.000 | 1.85 |
| MK7(◆) | 670.000 | 2.66 |
| MK8(◇) | 770.000 | 2.45 |

| | VERTICALLY POLARIZED WAVE | | | | | | | |
|---|---|---|---|---|---|---|---|---|
| FREQUENCY (MHz) | 76 | 78.5 | 81 | 83.5 | 86 | 95 | 101 | 107 |
| PEAK GAIN (dBd) | −8.71 | −8.57 | −8.16 | −6.91 | −5.50 | −3.85 | −6.00 | −7.76 |

| | HORIZONTALLY POLARIZED WAVE | | | | | | | |
|---|---|---|---|---|---|---|---|---|
| FREQUENCY (MHz) | 76 | 78.5 | 81 | 83.5 | 86 | 95 | 101 | 107 |
| PEAK GAIN (dBd) | −7.11 | −6.97 | −6.58 | −5.52 | −4.30 | −3.65 | −6.45 | −9.03 |

MEASUREMENT RESULT OF PEAK GAIN IN FM/VHF BAND

| | VERTICALLY POLARIZED WAVE | | | | | | | |
|---|---|---|---|---|---|---|---|---|
| FREQUENCY (MHz) | 470 | 520 | 570 | 620 | 670 | 720 | 770 | 906 |
| PEAK GAIN (dBd) | −12.73 | −18.18 | −8.15 | −13.74 | −14.80 | −7.55 | −9.85 | −4.28 |

| | HORIZONTALLY POLARIZED WAVE | | | | | | | |
|---|---|---|---|---|---|---|---|---|
| FREQUENCY (MHz) | 470 | 520 | 570 | 620 | 670 | 720 | 770 | 906 |
| PEAK GAIN (dBd) | −6.60 | −9.89 | −5.93 | −5.74 | −6.96 | −6.20 | −9.85 | −2.32 |

MEASUREMENT RESULT OF PEAK GAIN IN UHF BAND

| | VERTICALLY POLARIZED WAVE | | | | | | | |
|---|---|---|---|---|---|---|---|---|
| FREQUENCY (MHz) | 76 | 86 | 95 | 107 | 188.5 | 192.5 | 194.5 | 198.5 |
| PEAK GAIN (dBd) | -41.28 | -43.10 | -41.85 | -40.97 | -32.42 | -32.69 | -32.32 | -32.71 |

| | HORIZONTALLY POLARIZED WAVE | | | | | | | |
|---|---|---|---|---|---|---|---|---|
| FREQUENCY (MHz) | 76 | 86 | 95 | 107 | 188.5 | 192.5 | 194.5 | 198.5 |
| PEAK GAIN (dBd) | -39.84 | -41.10 | -40.25 | -38.10 | -25.92 | -25.29 | -25.44 | -25.10 |

MEASUREMENT RESULT OF PEAK GAIN OF
CONVENTIONAL DIPOLE ANTENNA IN FM/VHF BAND

| | VERTICALLY POLARIZED WAVE | | | | | | | |
|---|---|---|---|---|---|---|---|---|
| FREQUENCY (MHz) | 470 | 520 | 570 | 620 | 670 | 720 | 770 | 906 |
| PEAK GAIN (dBd) | -20.53 | -22.40 | -18.84 | -20.88 | -21.52 | -17.15 | -22.45 | -17.52 |

| | HORIZONTALLY POLARIZED WAVE | | | | | | | |
|---|---|---|---|---|---|---|---|---|
| FREQUENCY (MHz) | 470 | 520 | 570 | 620 | 670 | 720 | 770 | 906 |
| PEAK GAIN (dBd) | -0.20 | 0.80 | 0.56 | -2.08 | -3.87 | -4.15 | -3.05 | -8.57 |

MEASUREMENT RESULT OF PEAK GAIN OF CONVENTIONAL DIPOLE ANTENNA IN UHF BAND

16i

| | VERTICALLY POLARIZED WAVE | | | | | | | |
|---|---|---|---|---|---|---|---|---|
| FREQUENCY (MHz) | 76 | 78.5 | 81 | 83.5 | 86 | 95 | 101 | 107 |
| PEAK GAIN (dBd) | -9.11 | -8.97 | -8.38 | -7.12 | -5.90 | -4.25 | -6.80 | -8.50 |
| AVERAGE GAIN (dBd) | -12.88 | -12.56 | -12.03 | -10.69 | -9.34 | -7.72 | -9.89 | -11.22 |

16j

| | HORIZONTALLY POLARIZED WAVE | | | | | | | |
|---|---|---|---|---|---|---|---|---|
| FREQUENCY (MHz) | 76 | 78.5 | 81 | 83.5 | 86 | 95 | 101 | 107 |
| PEAK GAIN (dBd) | -7.31 | -7.17 | -6.78 | -5.52 | -4.50 | -3.85 | -7.00 | -9.63 |
| AVERAGE GAIN (dBd) | -11.35 | -11.20 | -10.85 | -9.66 | -8.63 | -8.83 | -12.14 | -14.50 |

16k

| | Total | | | | | | | |
|---|---|---|---|---|---|---|---|---|
| FREQUENCY (MHz) | 76 | 78.5 | 81 | 83.5 | 86 | 95 | 101 | 107 |
| PEAK GAIN (dBd) | -7.31 | -7.17 | -6.78 | -5.52 | -4.50 | -3.85 | -6.80 | -8.50 |
| AVERAGE GAIN (dBd) | -12.02 | -11.83 | -11.40 | -10.14 | -8.97 | -8.24 | -10.87 | -12.56 |

17i

| | VERTICALLY POLARIZED WAVE | | | | | | | |
|---|---|---|---|---|---|---|---|---|
| FREQUENCY (MHz) | 470 | 520 | 570 | 620 | 670 | 720 | 770 | 906 |
| PEAK GAIN (dBd) | -13.40 | -19.10 | -8.95 | -14.59 | -15.72 | -8.53 | -11.05 | -5.08 |
| AVERAGE GAIN (dBd) | -17.51 | -25.56 | -14.09 | -18.73 | -19.71 | -13.81 | -16.14 | -10.40 |

17j

| | HORIZONTALLY POLARIZED WAVE | | | | | | | |
|---|---|---|---|---|---|---|---|---|
| FREQUENCY (MHz) | 470 | 520 | 570 | 620 | 670 | 720 | 770 | 906 |
| PEAK GAIN (dBd) | -6.73 | -9.98 | -6.01 | -6.01 | -7.45 | -6.58 | -10.45 | -2.57 |
| AVERAGE GAIN (dBd) | -11.79 | -16.32 | -11.50 | -11.35 | -12.13 | -13.29 | -15.27 | -8.98 |

17k

| | Total | | | | | | | |
|---|---|---|---|---|---|---|---|---|
| FREQUENCY (MHz) | 470 | 520 | 570 | 620 | 670 | 720 | 770 | 906 |
| PEAK GAIN (dBd) | -6.73 | -9.98 | -6.01 | -6.01 | -7.45 | -6.58 | -10.45 | -2.57 |
| AVERAGE GAIN (dBd) | -13.77 | -18.84 | -12.60 | -13.63 | -14.44 | -13.54 | -15.68 | -9.64 |

EXAMPLE OF CONFIGURATION OF ANTENNA MOUNTED ON PORTABLE TERMINAL

| | VERTICALLY POLARIZED WAVE | | | | | | | |
|---|---|---|---|---|---|---|---|---|
| FREQUENCY (MHz) | 470 | 520 | 570 | 620 | 670 | 720 | 770 | 906 |
| PEAK GAIN (dBd) | -19.80 | -16.18 | -14.95 | -12.94 | -11.92 | -10.40 | -20.25 | -1.025 |

| | HORIZONTALLY POLARIZED WAVE | | | | | | | |
|---|---|---|---|---|---|---|---|---|
| FREQUENCY (MHz) | 470 | 520 | 570 | 620 | 670 | 720 | 770 | 906 |
| PEAK GAIN (dBd) | -10.80 | -6.38 | -2.55 | -2.94 | -5.52 | -4.75 | -7.65 | -3.81 |

MEASUREMENT RESULT OF PEAK GAIN OF ANTENNA
MOUNTED ON PORTABLE TERMINAL IN UHF BAND

EXAMPLE OF CONFIGURATION OF DIPOLE ANTENNA

| | VERTICALLY POLARIZED WAVE | | | | | | | |
|---|---|---|---|---|---|---|---|---|
| FREQUENCY (MHz) | 76 | 78.5 | 81 | 83.5 | 86 | 85 | 101 | 107 |
| PEAK GAIN (dBd) | -30.16 | -30.84 | -30.83 | -30.32 | -28.90 | -27.05 | -32.40 | -33.09 |

| | HORIZONTALLY POLARIZED WAVE | | | | | | | |
|---|---|---|---|---|---|---|---|---|
| FREQUENCY (MHz) | 76 | 78.5 | 81 | 83.5 | 86 | 85 | 101 | 107 |
| PEAK GAIN (dBd) | -12.64 | -13.37 | -12.93 | -11.28 | -9.10 | -6.85 | -17.57 | -28.14 |

MEASUREMENT RESULT OF PEAK GAIN OF
DIPOLE ANTENNA IN FM/VHF BAND

EXAMPLE OF CONFIGURATION OF CABLE ANTENNA

ELECTROSTATIC CAPACITANCES C1<C2<C3

EXAMPLE OF CONFIGURATION OF EVALUATION DIPOLE ANTENNA (NO FOLDED STRUCTURE)

RESONANT FREQUENCY f1=RESONANCE AT LENGTH OF L1
RESONANT FREQUENCY f2=RESONANCE AT LENGTH OF L1+L2

EXAMPLE OF CONFIGURATION OF EVALUATION DIPOLE ANTENNA (ONE FOLDED STRUCTURE)

RESONANT FREQUENCY f1=RESONANCE AT LENGTH OF L1
RESONANT FREQUENCY f2=RESONANCE AT LENGTH OF L1+L2
RESONANT FREQUENCY f3=RESONANCE AT LENGTH OF L1+L2+L3

EXAMPLE OF CONFIGURATION OF EVALUATION DIPOLE ANTENNA (TWO FOLDED STRUCTURES)

ANTENNA

CROSS REFERENCES TO RELATED APPLICATIONS

The present application is a national stage of International Application No. PCT/JP2010/068765 filed on Oct. 12, 2010 and claims priority to Japanese Patent Application No. 2009-236406 filed on Oct. 13, 2009, and Japanese Patent Application No. 2010-210856 filed on Sep. 21, 2010, the disclosures of which are incorporated herein by reference.

BACKGROUND

The present invention relates to an antenna, and particularly to an antenna that has a simple configuration without use of a dedicated antenna element.

Hitherto, various kinds of antennas have been used as antennas that receive various broadcast waves such as television broadcast or FM broadcast. For example, dipole antennas or Yagi-Uda antennas are frequently used to receive television broadcast or FM broadcast. On the other hand, chances to receive such various broadcast waves or signals carried by the broadcast waves indoors, inside vehicles, or on the road have increased. In these cases, the antennas are required to be easily handled for assembly, mounting, or the like. For example, Patent Literature 1 discloses a monopole antenna having a simple configuration of an antenna element.

CITATION LIST

Patent Literature

Patent Literature 1: JP 2004-328364A

SUMMARY

Technical Problem

However, the conventional antennas including the monopole antenna disclosed in Patent Literature 1 have to include an antenna element that receives radio waves. In other words, an antenna having no dedicated antenna element that receives radio waves has not been devised.

Additional features and advantages are described herein, and will be apparent from the following Detailed Description and the figures.

The invention provides an antenna that has a simple mechanism without use of a dedicated antenna element.

Solution to Problem

During studies, the inventors discovered by chance an antenna realized with a simple mechanism that has a lesser number of components without providing a dedicated antenna element.

According to the first aspect of the present invention in order to achieve the above-mentioned object, there is provided an antenna including: a first conductor that has a first line length from a start point to a folded point; and a second conductor that has a second line length in a direction from the folded point to the start point and is electrically connected to the first conductor at the folded point. In the antenna according to the aspect of the invention, a first received signal with a first frequency is received by a conductor with a first antenna length corresponding to a length of the first line length and the second line length combined. Further, a second received signal with a second frequency is received by a conductor with a second antenna length corresponding to one of the first line length and the second line length.

Accordingly, the start point serves as the feeding point and one antenna receives both radio waves with the first and second frequencies by the first and second conductors.

Further, the antenna can be miniaturized since the antenna length necessary to receive radio waves can be shortened to a length shorter than the conventional antenna length required to receive the radio waves.

Advantageous Effects of Invention

According to the present invention, the antenna can be realized with the simple mechanism without use of a dedicated antenna element.

Additional features and advantages are described herein, and will be apparent from the following Detailed Description and the figures.

DETAILED DESCRIPTION

Hereinafter, modes for carrying out the invention (hereinafter referred to as embodiments) will be described. The description will be made in the following order.

1. Description of Basic Configuration and Basic Principle of Antenna
2. First Embodiment (Example of Configuration in Which Length of Antenna is Determined by use of High-frequency Attenuation Member)
3. Second Embodiment (Example of Configuration in Which High-frequency Attenuation Member is Not Used)
4. Various Modifications of First and Second Embodiments <1. Description of Basic Configuration and Basic Principle of Antenna>

[Example of Basic Configuration of Antenna]

Figure 1:
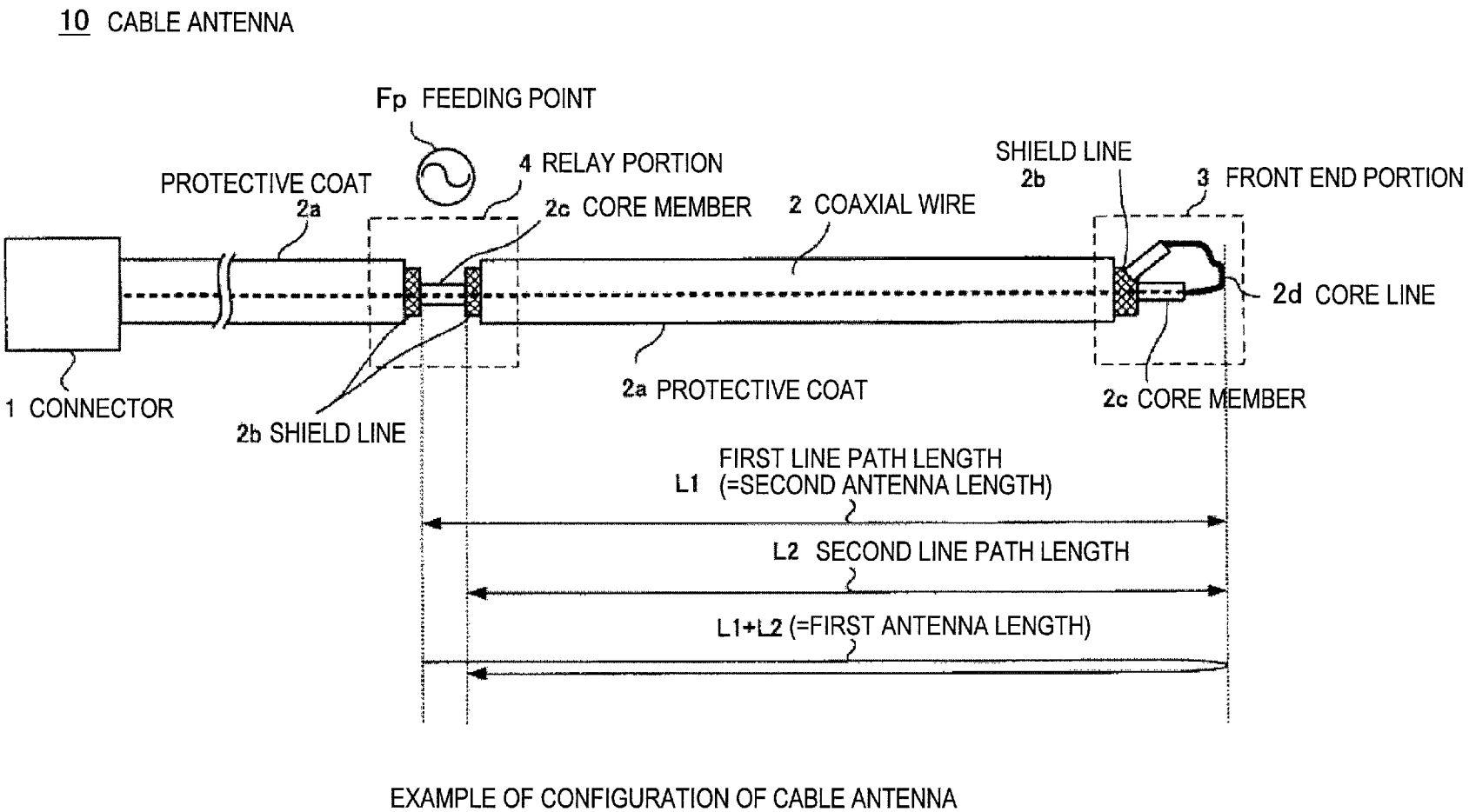
FIG. 1 is a diagram illustrating an example of the configuration of a cable antenna according to the invention.

FIG. 1 is a diagram illustrating an example of the configuration of a cable antenna using a coaxial wire (coaxial cable) according to an embodiment of the invention. A cable antenna 10 shown in FIG. 1 is configured by a coaxial wire 2 connected to a connector 1 connected to a receiver (not shown). It is desirable to select a connector for which a loss of a high-frequency signal is small, as the connector 1. A front end portion 3 of the coaxial wire 2 opposite to the side connected to the connector 1 is molded by a resin such as elastomer. In an inside of the front end, a core member 2*c* (dielectric) and a core line 2*d* (first or second conductor) are exposed by removing a protective coat 2*a* and a shield line 2*b* (first or second conductor). The front end of the core line 2*d* extending from the core member 2*c* is connected to the shield line 2*b* by soldering or the like.

A relay portion 4 is formed at a position of a predetermined length from the front end portion 3 to the side of the connector 1. The relay portion 4 is also molded like the front end portion 3. In the inside of the relay portion, the core member 2*c* (dielectric) is exposed by removing the protective coat 2*a* and the shield line (external conductor) 2*b* of the coaxial wire 2. The relay portion serves as a feeding point Fp of the cable antenna 10 of this example. With such a configuration, the coaxial wire 2 (specifically, the shield line 2*b* and the core line 2*d*) between the feeding point Fp, which is the start point, and the front end portion 3, which is the folded point, serves as an antenna element. The shield line 2*b* of the coaxial wire 2 connected to the connector 1 serves as a ground (hereinafter referred to as GND) and an image current (electric image current) flows in the shield line 2*b*. That is, a $\lambda/2$ dipole antenna is configured by the antenna element and the electric image.

Figure 2:
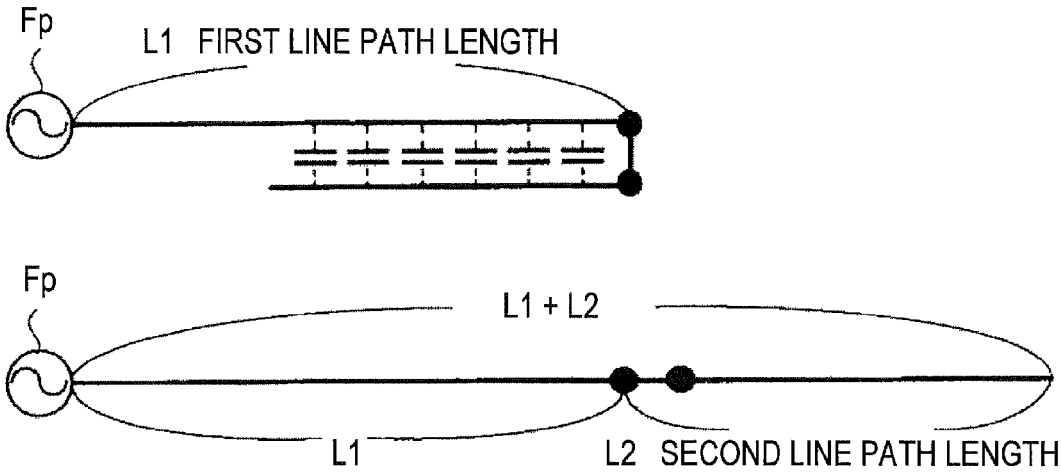
FIG. 2 is a diagram illustrating a principle of the cable antenna according to the invention.

At this time, between the shield line 2*b* and the core line 2*d* of the portion serving as the antenna element, impedance connection is equivalently present between the start point and the folded point. The impedance value is different between a low frequency (first frequency) and a high frequency (second frequency). In the configuration shown in the drawing, connection is made at high frequency (short-circuit: capacitive coupling) in the side of the high frequency in accordance with a potential capacitive reactance (capacitive component), and thus relatively low impedance is obtained. As a result, there are two kinds of antenna lengths (dual resonance) corresponding to two kinds of frequencies. Hereinafter, a relation between the antenna length and the high-frequency impedance connection equivalently present in a portion serving as an antenna element will be described with reference to FIG. 2. In FIG. 2, a solid line indicates an element serving as an antenna for the cable antenna 10 and two points ● (black circles) indicate a folded portion of the front end portion 3.

First, when a high frequency (second frequency) is received, as shown in FIG. 1 and the upper drawing of FIG. 2, high capacitive coupling occurs between the shield line 2*b* and the core line 2*d* in the above-described impedance connection portion (high-frequency connection portion). When this capacitive coupling occurs, a first line length L1 which is the line length from the feeding point Fp to the folded point becomes an antenna length (second antenna length), so that radio waves can be received. The first line length L1 is equal to the length from the cut portion of the shield line 2*b* of the portion serving as the above-described GND to the folded point of the front end portion 3 of the portion serving as the antenna element.

On the other hand, when a low frequency (first frequency) is received, the capacitive coupling decreases in accordance with this frequency, and thus the impedance of the impedance connection portion increases. Accordingly, as shown in FIG. 1 and the lower drawing of FIG. 2, the antenna length (first antenna length) is equal to the line length which is a sum of adding the first line length L1 and a line length (second line length) L2 of the portion folded in the folded point. The second line length L2 is equal to a length from the folded point in the front end portion 3 to the cut portion of the shield line 2*b* of the portion serving as the antenna element inside the relay portion 4.

In the cable antenna 10 with the above-described configuration, radio waves with two different arbitrary frequencies can be received by determining the first line length or the second line length based on the wavelength of the frequency of a radio wave desired to be received. In FIG. 1, the example in which the cable antenna 10 is configured by the use of the coaxial wire 2 has been described, but the invention is not limited thereto. For example, the same cable antenna 10 can be configured even by the use of another wire, such as a feeder line, in which two conductive lines (conductors) are disposed to be substantially parallel.

[Example of Design of Antenna]

Figure 3:
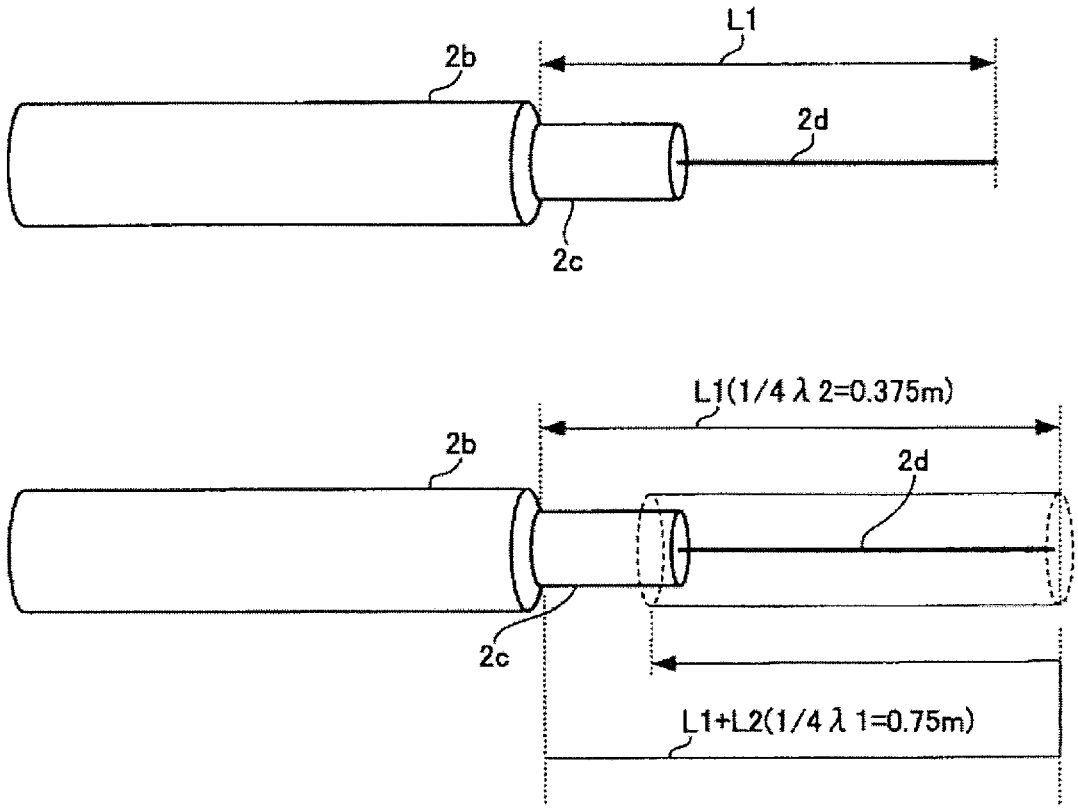
FIG. 3 is a diagram illustrating an example of the design of the cable antenna according to the invention.

Next, a method of determining the actual line length of the cable antenna 10 based on two frequencies desired to be received will be described with reference to FIG. 3. To facilitate the description, the protective coat 2*a* (see FIG. 1) of the coaxial wire 2 is not illustrated in FIG. 3. To facilitate the description, the core member 2*c* cut in the middle portion of the coaxial wire 2 is illustrated in FIG. 3. However, as shown in FIG. 1, the core member 2*c* extends up to the front end portion 3.

In the example shown in FIG. 3, it is assumed that the wavelengths of the two frequencies desired to be received are wavelengths λ1 and λ2 and the lengths of the wavelengths satisfy a relation of the wavelength λ1>the wavelength λ2. That is, for example, when the radio waves of 100 MHz and 200 MHz are received, the wavelength λ1 is equal to 3 m and the wavelength λ2 is equal to 1.5 m.

Next, the antenna length is defined to receive the wavelengths λ1 and λ2. Specifically, the length (first line length) of the portion serving as the antenna element is determined so that the resonance lengths of the wavelengths λ1 and λ2 are each λ/4 (see the upper drawing of FIG. 3). When the wavelength λ1 is 3 m, the resonant length (first antenna length) of the wavelength λ1 is 0.75 m and the wavelength λ2 is 1.5 m, so that the resonance length (second antenna length) of the wavelength λ2 is 0.375 m. That is, when the first line length is set to 0.75 m, this portion resonates with the 100 MHz radio wave. When the first line length is set to 0.375 m, this portion resonates with the 200 MHz radio wave.

However, in the cable antenna 10 of this example, as described above, the high-frequency capacitive coupling occurs in the portion serving as the antenna element when the second frequency which is a higher frequency is received. No capacitive coupling occurs when the first frequency which is a low frequency is received. From the viewpoint of the characteristics, if the second antenna length (0.375 m) is set as the first line length L1 and the length obtained by subtracting the second antenna length (0.375 m) from the first antenna length (0.75 m) is folded from the folded point, two frequencies can be received with the first line length L1 (see the lower drawing of FIG. 3). Accordingly, even when the first line length is formed by the second antenna length which is half of the first antenna length, the radio wave with the first frequency to be received with the first antenna length can be received. That is, the line length necessary to receive the radio wave with the low frequency of a long wavelength can be set to half of the line length considered to be generally necessary.

Further, it is desirable that the length of a portion serving as the GND be a quarter or more of the wavelength λ1 of the first frequency. That is, in the example shown in FIG. 3, it is desirable that the length of the portion serving as the GND be 0.75 m or more. At this time, the length of the coaxial wire 2 of the portion serving as the GND is exactly cut by a quarter of the wavelength λ1, but may not be cut and the long length may be used.

Figure 4:
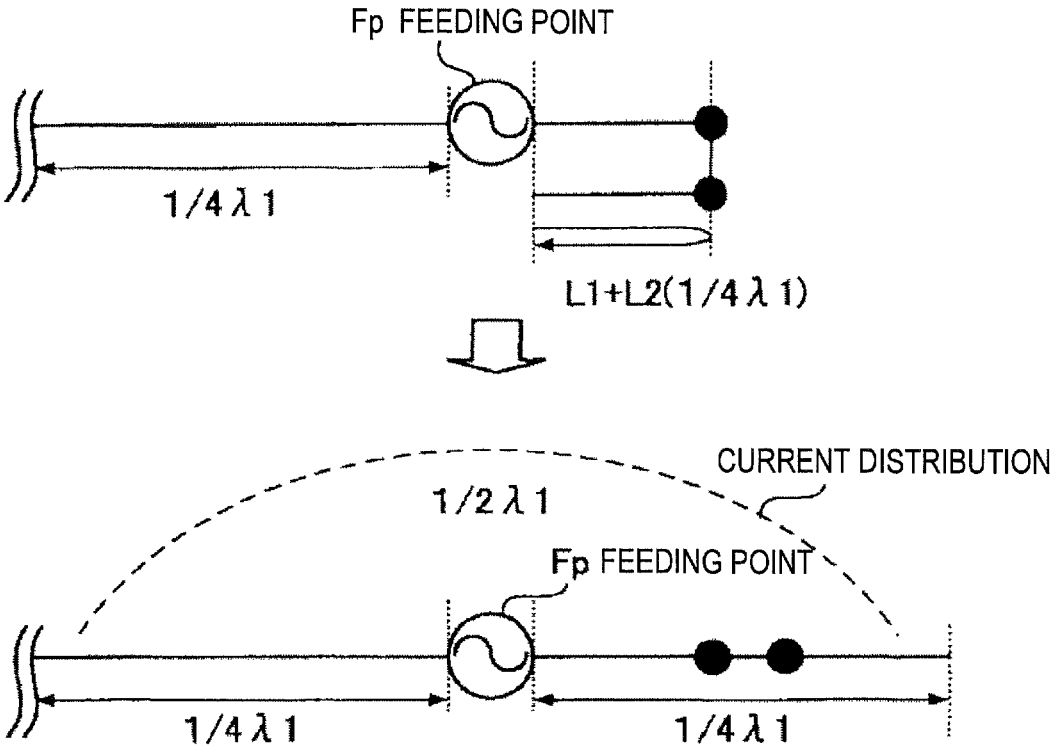
FIG. 4 is an equivalent circuit diagram when the cable antenna of the invention resonates with a radio wave at a second frequency.
Figure 5:
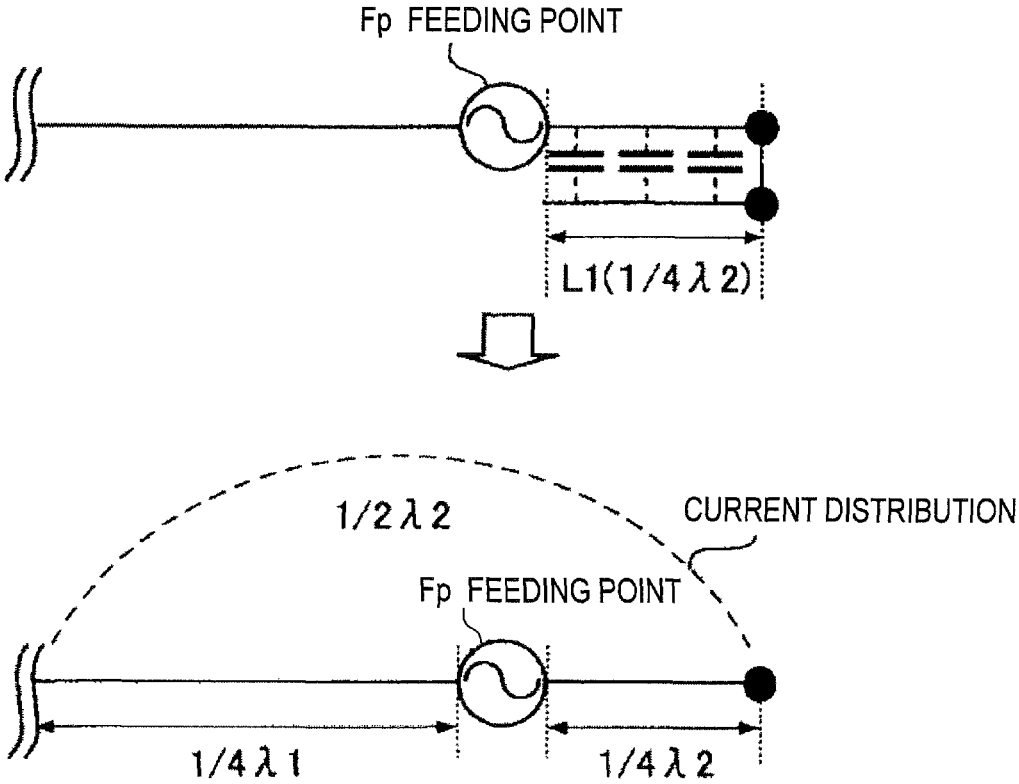
FIG. 5 is an equivalent circuit diagram when the cable antenna of the invention resonates with a radio wave at a first frequency.

FIGS. 4 and 5 are diagrams illustrating equivalent circuits of the cable antenna 10 when the cable antenna 10 of this example is configured as in the lower drawing of FIG. 3. FIG. 4 is an equivalent circuit diagram when the cable wire resonates at the first frequency with the wavelength λ1. FIG. 5 is an equivalent circuit diagram when the cable wire resonates at the second frequency with the wavelength λ2. When the cable antenna 10 receives the radio wave with the first frequency, as shown in the upper drawing of FIG. 4, the high-frequency capacitive coupling is small in the folded portion of the antenna. Therefore, as shown in the lower drawing of FIG. 4, the cable wire with the length (½λ1), which is a sum of a line length (=¼λ1) extended by the length of the folded portion and the line length of ¼λ1 serving as the GND, resonates at the first frequency with the wavelength λ1.

On the other hand, when the cable antenna 10 receives the radio wave with the second frequency which is a higher frequency, as shown in the upper drawing of FIG. 5, the cable wire with a length (½λ2) which is a sum of the first line length L1 (¼λ2) and the line length of ¼λ1 serving as the GND resonates at the second frequency with the wavelength λ2 by the high-frequency capacitive coupling in the folded portion of the antenna, as shown in the lower drawing of FIG. 5.

In FIGS. 3 to 5, the example in which the second antenna length is exactly half of the first antenna length (the wavelengths λ1 and λ2 have a relation of 1:2) has been described, but the invention is not limited thereto. Even with a relation other than the relation in which the ratio of the wavelengths λ1 and λ2 is 1:2, the cable antenna 10 of this example can be configured by setting the second antenna length to the first line length L1 and folding the length obtained by subtracting the second antenna length from the first antenna length from the folded point. In this case, the first line length L1 is not ¼λ but ½λ or ¾λ. The actual first line length, the actual second line length, or the line length of the portion serving as the GND is adjusted by the size of the GND of an apparatus to be used.

<2. First Embodiment>

[Example of Configuration of Antenna]

Figure 6:
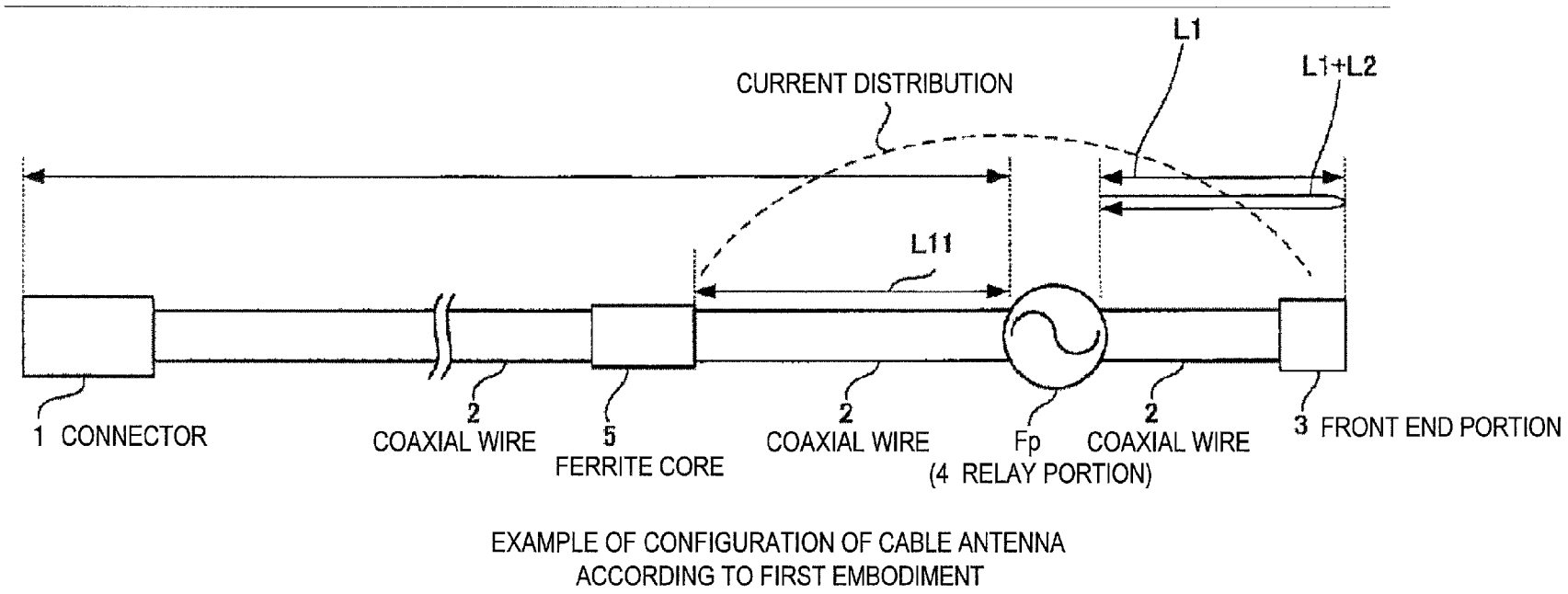
FIG. 6 is a diagram illustrating an example of the configuration of a cable antenna according to a first embodiment of the invention.

Next, an example of the configuration of the cable antenna 10 will be described with reference to FIG. 6 when the antenna length is determined by the use of a high-frequency attenuation member according to a first embodiment of the invention. In FIG. 6, the same reference numerals are given to portions corresponding to the portions of FIG. 1 and the detailed description will not be repeated. In the example shown in FIG. 6, a ferrite core 5 is used as the high-frequency attenuation member. By disposing the ferrite core 5 at a desired position of the coaxial wire 2 distant by ¼ or more of the first frequency λ1 from the feeding point Fp (the relay portion 4) in the direction of the connector 1, no radio wave is loaded on the coaxial wire 2 from the ferrite core 5 to the connector 1. Thus, the antenna length can be determined without consideration of the line length from the ferrite core 5 to the connector 1.

[Verifying Characteristics of Antenna]

To verify the theory of the invention, the inventors carried out an experiment of receiving radio waves by fixing a length (line length) L11 from the feeding point Fp to the ferrite core 5 of the cable antenna 10 with the above-described configuration and varying the length of the first line length L1. First, the characteristics of the antenna are verified when the first line length L1 is determined based on the first antenna length without setting the first line length L1 to half (equal to the second antenna length) of the first antenna length. In theory, the coaxial wire with the first length L1+the line length L11 resonates at one frequency and the coaxial wire with the first line length L1+the second line length L2+the line length L11 resonates at another frequency. In this experiment, the length L11 from the feeding point Fp to the ferrite core 5 is fixed to 98 cm so that the coaxial cable resonates at 85 MHz.

Figure 7:
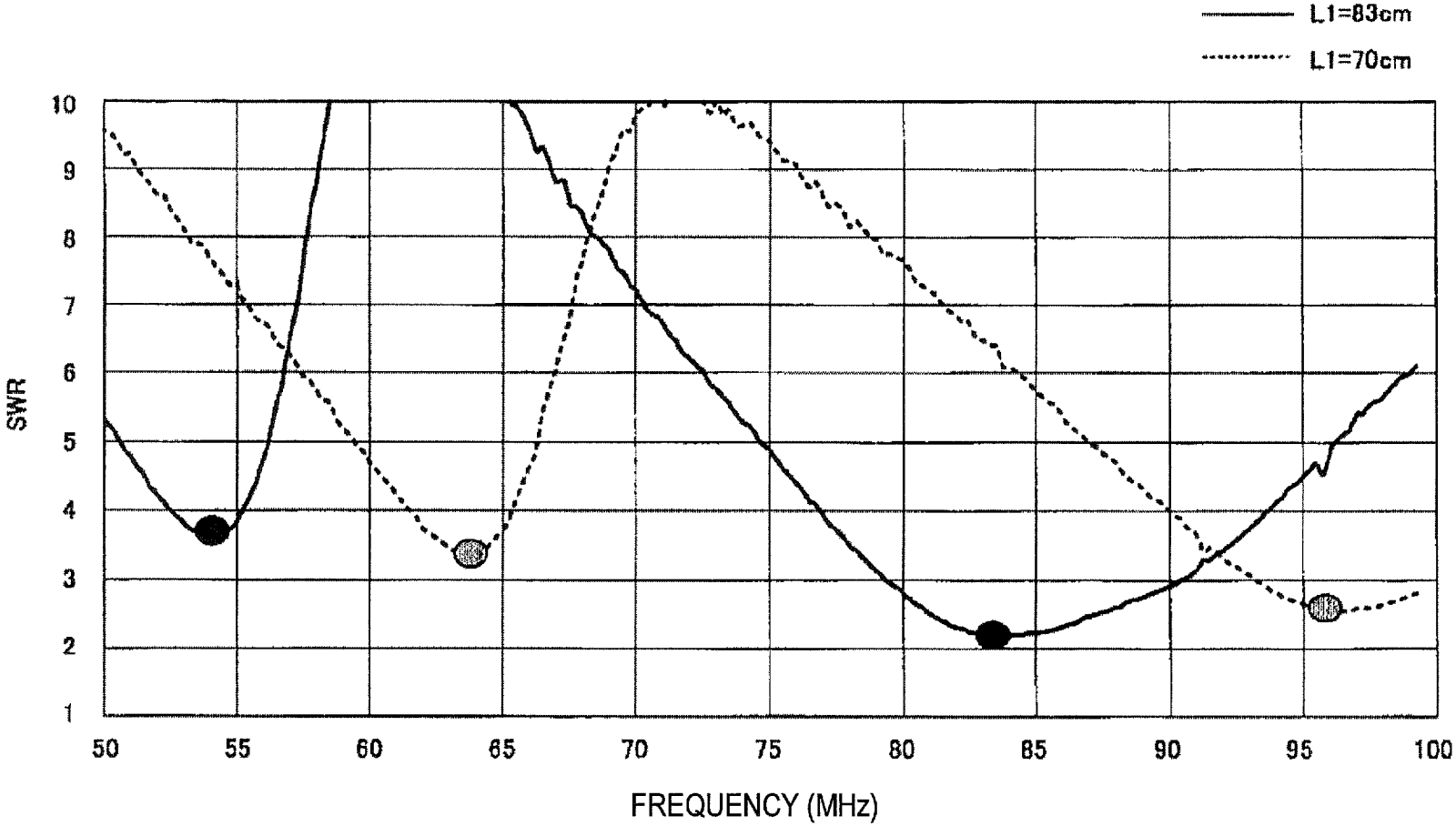
FIG. 7 is a graph illustrating an example of a resonant frequency of the cable antenna according to the first embodiment of the invention.

FIG. 7 is a diagram illustrating the position of a resonance point when the first line length L1 is set to 83 cm and 70 cm. In FIG. 7, the horizontal axis represents a frequency (MHz) and the vertical axis represents a standing wave ratio (SWR). When the first line length L1 is set to 83 cm, the SWR is indicated by a solid line. When the first line length L1 is set to 70 cm, the SWR is indicated by a dotted line. When the first line length L1 is set to 83 cm, the SWR becomes 4 or less at about 54 MHz and about 84 MHz, and thus it can be understood that resonance occurs. Further, when the first line length L1 is set to 70 cm, the SWR becomes 4 or less at about 64 MHz and about 96 MHz, and thus it can be understood that resonance occurs. That is, it is verified that the cable antenna 10 configured by the coaxial wire 2 resonates at two different frequencies.

Figure 8:
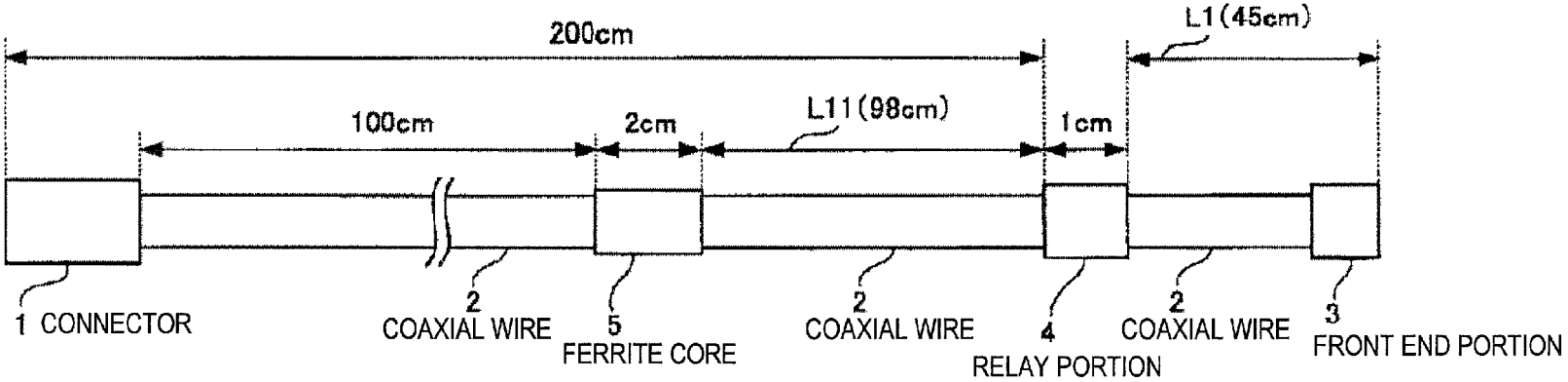
FIG. 8 is a diagram illustrating an example of the configuration of the cable antenna when a first line length of the cable antenna is set to half thereof according to the first embodiment of the invention.

Next, the characteristics of the antenna are also verified when the first line length L1 is set to half (equal to the second antenna length) of the first antenna length. FIG. 8 is a diagram illustrating an example of the configuration of the cable antenna 10 in this case. In FIG. 8, the same reference numerals are given to portions corresponding to the portions of FIG. 1 or 6, and the description thereof will not be repeated. In the cable antenna 10 shown in FIG. 8, the line length L11 is set to 98 cm and the first line length L1 is set to 45 cm, as in the example shown in FIG. 7. That is, the first line length L1 is set to about half of 83 cm considered to be necessary in order to receive the 85 MHz radio wave.

Figure 9:
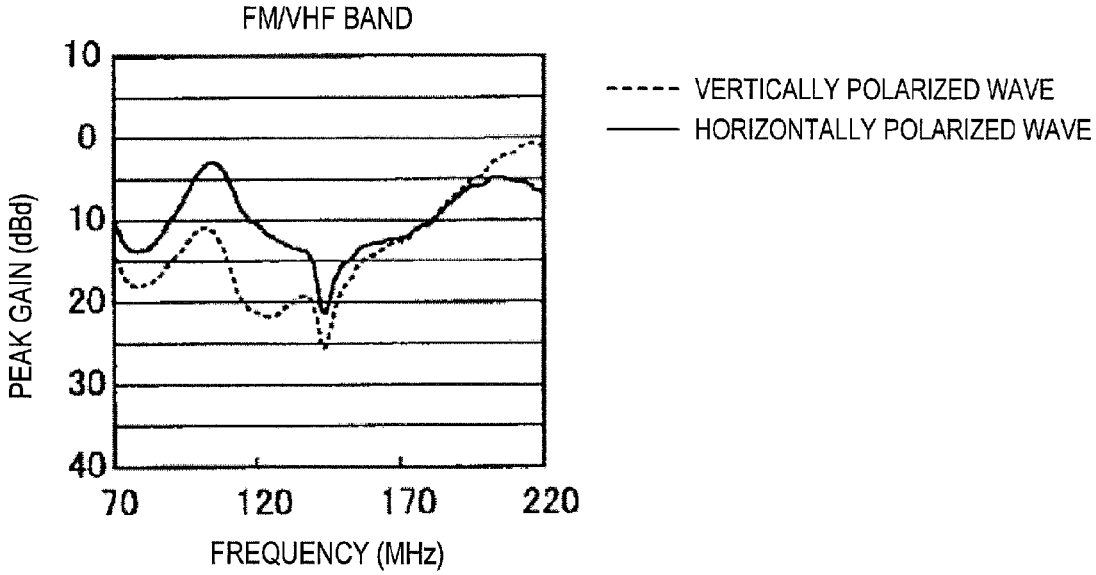
FIG. 9 is a graph and a table illustrating a measurement result of a peak gain of the cable antenna in the FM/VHF band according to the first embodiment of the invention.

The upper drawing of FIG. 9 shows a graph that indicates a peak gain of the cable antenna 10 with the configuration described with reference to FIG. 8 in a vertically polarized wave and horizontally polarized wave. The horizontal axis represents a frequency (MHz) and the vertical axis represents a peak gain (dBd). The frequency band of a measurement target is set to the FM/VHF band (70 MHz to 220 MHz). The vertically polarized wave is indicated by a dashed line and the horizontally polarized wave is indicated by a solid line. The intermediate drawing of FIG. 9 and the lower drawing of FIG. 9 show values of measured points in the graph shown in the upper drawing of FIG. 9. The intermediate drawing of FIG. 9 shows the values of the peak gain in the vertically polarized wave. The lower drawing of FIG. 9 shows the values of the peak gain in the vertically polarized wave. Further, the intermediate drawing of FIG. 9 and the lower drawing of FIG. 9 show only the measured values in the frequencies from 76 MHz to 107 MHz among the frequencies shown in the horizontal axis of the upper drawing of FIG. 9.

As shown in the upper drawing of FIG. 9 and the intermediate drawing of FIG. 9, near 85 MHz, the peak gain of the vertically polarized wave is −11.90 dBd at 86 MHz and is −6.85 dBd at 95 MHz. As shown in the upper drawing of FIG. 9 and the lower drawing of FIG. 9, the peak gain in the horizontally polarized wave is −16.70 dBd at 86 MHz and is −13.05 dBd at 95 MHz. That is, it can be understood that the cable antenna 10 of this example receives both the vertically polarized wave and the horizontally polarized wave in the FM/VHF band by the resonance near these frequencies.

[Advantageous Effects of First Embodiment]

In the above-described embodiment, the portion in which the protective coat 2*a* and the shield line 2*b* of the coaxial wire 2 are removed serves as the feeding point Fp, and the core line 2*d* connected to the shield line 2*b* by the front end portion 3 and the shield line 2*b* receives the radio waves. Accordingly, since the antenna has a simple configuration in which a dedicated antenna element, a connection substrate, or the like is not used, the antenna can be realized with low cost.

In the above-described embodiment, the first line length L1 up to the folded point (the front end portion 3) and the line length (the first line length+the second line length) extended by the folded portion resonate at different frequencies in accordance with the received frequencies. Specifically, when the radio wave with the first frequency with a long wavelength is received, the first line length+the second line length is the first antenna length. When the radio wave with the second frequency with a short wavelength is received, the first line length is the second antenna length. That is, since two different antenna lengths (the first and second antenna lengths) are realized with the cable length corresponding to the first line length in accordance with the magnitude of the frequency by the folded structure, the radio waves with two kinds of frequencies can be received. That is, even when the low frequency (first frequency) is desired to be received, the length (cable length) necessary to receive the low frequency can be made to be half (the first line length) of the actually required antenna length (the first line length+the second line length). That is, the antenna may be miniaturized.

Further, the received frequency can be changed arbitrarily by adjusting the length of the first and second line lengths or the folded length at the folded point.

When the ferrite core 5 is mounted as a high-frequency blocking member at a desired position between the feeding point Fp and the connector 1, no radio wave is loaded from the ferrite core 5 to the connector 1. That is, the length of the coaxial wire 2 from the ferrite core 5 to the connector 1 may not be taken into consideration when the antenna length is designed. Accordingly, since the length of the coaxial wire 2 from the ferrite core 5 to the connector 1 can be set to any value, the degree of freedom can be improved for the disposition position of the cable antenna 10 of this example or a receiving apparatus.

Since the ferrite core 5 is mounted at a desired position between the feeding point Fp and the connector 1 to serve as a high-frequency blocking member, noise generated from the receiving apparatus can be prevented from being loaded to the antenna.

<3. Second Embodiment>

[Example of Configuration of Antenna]

Figure 10:
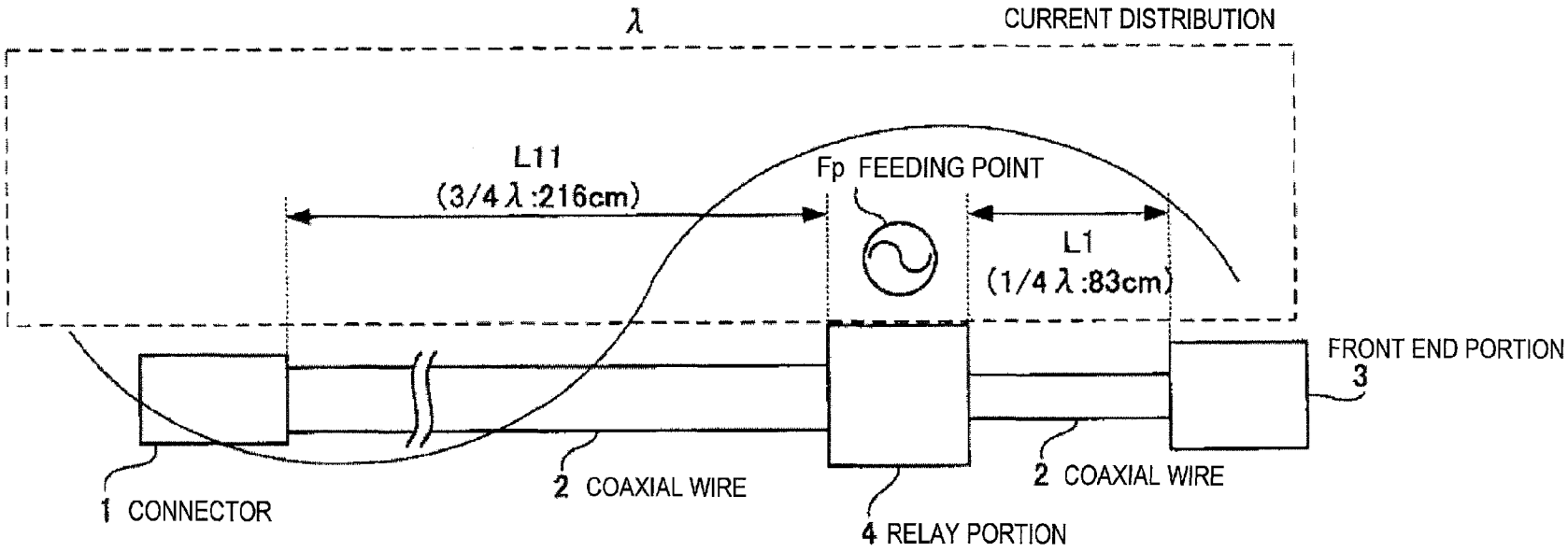
FIG. 10 is a diagram illustrating an example of the configuration of a cable antenna according to a second embodiment of the invention.

Next, an example of the configuration of the cable antenna 10 will be described with reference to FIG. 10 when the antenna length is determined without use of a high-frequency attenuation member according to a second embodiment of the invention. In FIG. 10, the same reference numerals are given to portions corresponding to the portions of FIGS. 1, 6, and 8 and the detailed description will not be repeated. In the example shown in FIG. 10, when the high-frequency attenuation member is not used, a radio wave is loaded to the entire coaxial wire 2. Therefore, it is desirable that the length of a portion serving as the GND be cut in a unit of λ. In the cable antenna 10 shown in FIG. 10, the radio wave is actively loaded even to the portion (line length L11) serving as the GND. Therefore, the first line length L1 serving as an antenna element is set to ¼λ, whereas the line length L11 is set to ¾λ. Here, the first line length is set to 83 cm so that a conductor with the second antenna length (the use of only the first line length) resonates at 85 MHz.

Accordingly, the length of the line length L11 becomes 216 cm.

Figure 11:
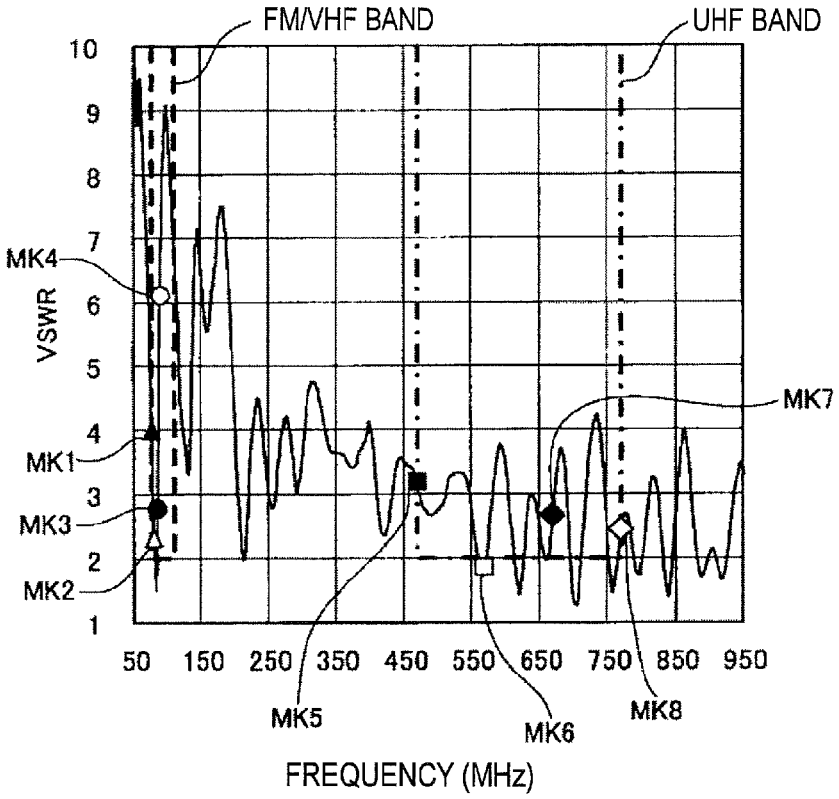
FIG. 11 is a graph and a table illustrating an example of VSWR characteristics in the FM/VHF band of the cable antenna according to the second embodiment of the invention.

FIG. 11 is a diagram illustrating a voltage standing wave ratio (VSWR) when the cable antenna 10 has the configuration shown in FIG. 10. The horizontal axis represents a frequency (MHz) and a vertical axis represents the VSWR. Frequencies of a plurality of measurement points on a graph shown in the upper drawing of FIG. 11 and the values of the VSWR are shown in the lower drawing of FIG. 11.

As shown in the upper drawing of FIG. 11 and the lower drawing of FIG. 11, the VSWR is 2.33 at the measurement point MK2 (80 MHz), and thus it can be understood that the cable antenna 10 resonates at 80 MHz. Even in the UHF band (470 MHz to 770 MHz) indicated by a one-dot chain line, the VSWR is 3 or less particularly at a measurement point MK6 (570 MHz) to a measurement point MK7 (770 MHz). That is, it can be understood that the cable antenna 10 resonates even in the UHF band corresponding to the high frequency of the FM/VHF band.

Figure 12:
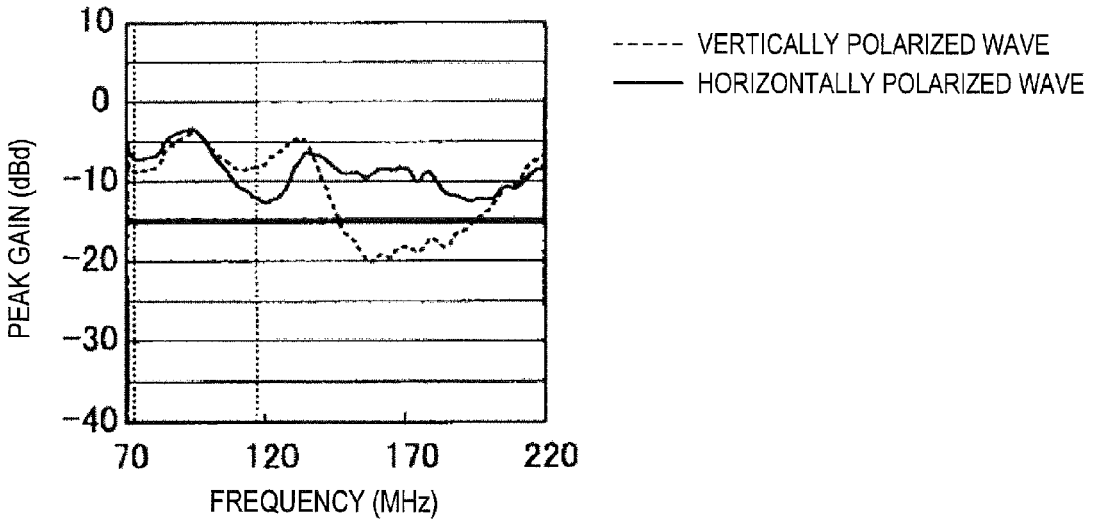
FIG. 12 is a graph and a table illustrating a measurement result of a peak gain of the cable antenna in the FM/VHF band according to the second embodiment of the invention.
Figure 13:
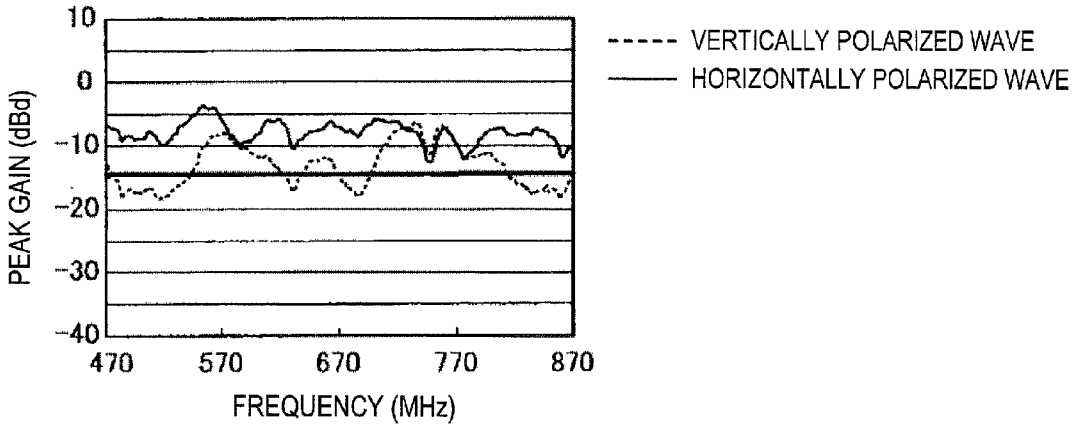
FIG. 13 is a graph and a table illustrating a measurement result of a peak gain of the cable antenna in the UHF band according to the second embodiment of the invention.

FIGS. 12 and 13 are graphs illustrating a peak gain of the able antenna 10 having the antenna configuration shown in FIG. 10 in a vertically polarized wave and a horizontally polarized wave. FIG. 12 shows the values of the peak gain in the FM/VHF band. FIG. 13 shows the values of the peak gain in the UHF band. In the graphs shown in the upper drawing of FIG. 12 and the upper drawing of FIG. 13, the horizontal axis represents a frequency (MHz) and the vertical axis represents a peak gain (dBd). The vertically polarized wave is indicated by a dashed line and the horizontally polarized wave is indicated by a solid line. The intermediate drawing of FIG. 12 and the intermediate drawing of FIG. 13 show tables representing the values of the measurement points of the graphs shown in the upper drawing of FIG. 12 and the upper drawing of FIG. 13, respectively. Further, the intermediate drawing of FIG. 12 shows only the measured values in the frequencies from 76 MHz to 107 MHz (in a range indicated by a vertical dashed line in the upper drawing of FIG. 12) among the frequencies shown in the horizontal axis of the upper drawing of FIG. 12.

The peak gains in both the vertically polarized wave and the horizontally polarized wave are —15 dB or less, particularly between 76 MHz to 107 MHz in the FM/VHF band shown in the upper drawing of FIG. 12 and the intermediate drawing of FIG. 12. Further, the peak gains in both the vertically polarized wave and the horizontally polarized wave are −15 dB or less even in the UHF band shown in the upper drawing of FIG. 13 and the intermediate drawing of FIG. 13. That is, it can be understood that the cable antenna 10 of this example receives both the vertically polarized wave and the horizontally polarized wave in both the FM/VHF band and the UHF band by the resonance near these frequencies.

When an antenna is installed on the roof or the like of a building to receive television broadcast, the antenna is disposed at a position at which a radio wave tower such as Tokyo Tower is viewed. In this case, since no obstruction is present between the radio wave tower and the antenna, a polarization direction of the radio waves transmitted from the radio wave power is not changed during traveling of the radio waves. On the other hand, the radio waves arriving at an antenna used indoors, inside a vehicle, or in a portable terminal are reflected from obstruction objects such as buildings present between the radio wave tower and the antenna in many cases. For this reason, the antenna used in such an environment is required to receive both a vertically polarized wave and a horizontally polarized wave. That is, the cable antenna 10 of this example is configured to satisfy this requirement.

Figure 14:
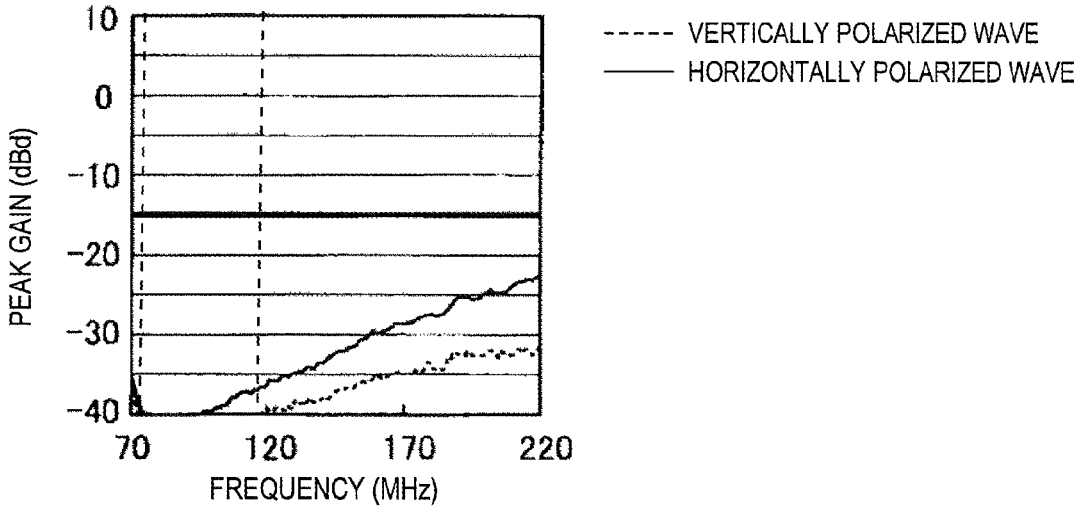
FIG. 14 is a graph and a table illustrating a measurement result of a peak gain of a conventional dipole antenna in the FM/VHF band.
Figure 15:
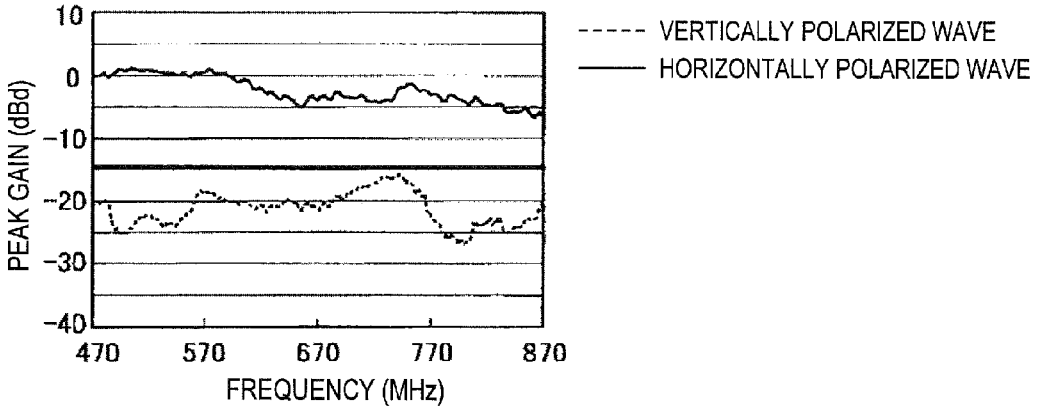
FIG. 15 is a graph and a table illustrating a measurement result of a peak gain of a conventional dipole antenna in the UHF band.

FIGS. 14 and 15 are diagrams illustrating a measurement result of the peak gain of a conventional dipole antenna designed to receive a radio wave with 500 MHz of the UHF band in each frequency band. FIG. 14 shows the values of the peak gain in the FM/VHF band. FIG. 15 shows the values of the peak gain in the UHF band. In the graphs shown in the upper drawing of FIG. 14 and the upper drawing of FIG. 15, the horizontal axis represents a frequency (MHz) and the vertical axis represents a peak gain (dBd). The vertically polarized wave is indicated by a dashed line and the horizontally polarized wave is indicated by a solid line. The intermediate drawing of FIG. 14 and the intermediate drawing of FIG. 15 show tables representing the values of the measurement points of the graphs shown in the upper drawing of FIG. 14 and the upper drawing of FIG. 15, respectively. Further, the intermediate drawing of FIG. 14 shows only the measured values in the frequencies from 76 MHz to 107 MHz (in a range indicated by a vertical dashed line in the upper drawing of FIG. 14) among the frequencies shown in the horizontal axis of the upper drawing of FIG. 14.

In the dipole antenna designed to receive the 500 MHz radio wave, as shown in the upper drawing of FIG. 14 and the intermediate drawing of FIG. 14, it can be understood that the value of the peak gain is −20 dB or more in both the vertically polarized wave and the horizontally polarized wave in the VHF band and the antenna gain is not obtained. Even in the dipole antenna, the radio wave of the VHF band can be received when the antenna length is made to be lengthened. However, in this case, the size of the antenna itself may increase by necessity.

In the UHF band, as shown in the upper drawing of FIG. 15 and the intermediate drawing of FIG. 15, it can be understood that the horizontally polarized wave indicated by the solid line is relatively well received, but the vertically polarized wave indicated by a dashed line is rarely received in that the peak gain of each frequency is −15 dB or less.

Figure 16:
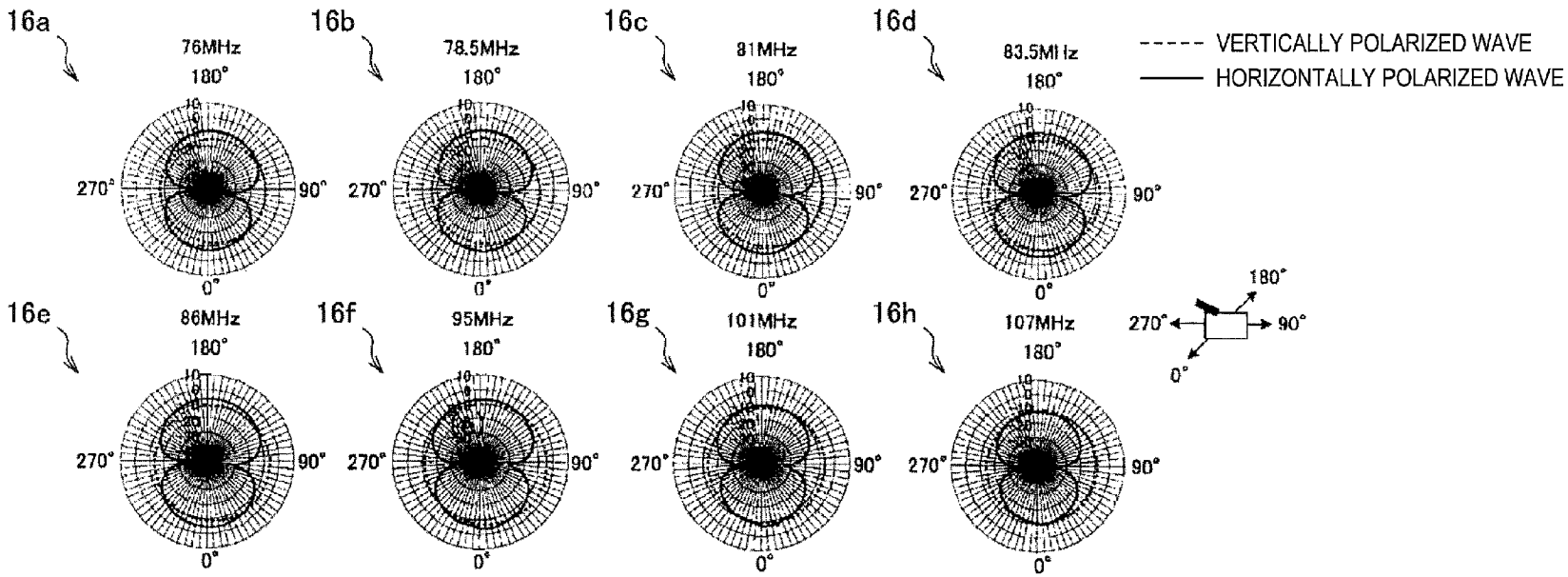
FIG. 16 is a graph and a table illustrating a measurement result of a peak gain and an average gain of the cable antenna in the FM/VHF band according to the second embodiment of the invention.
Figure 17:
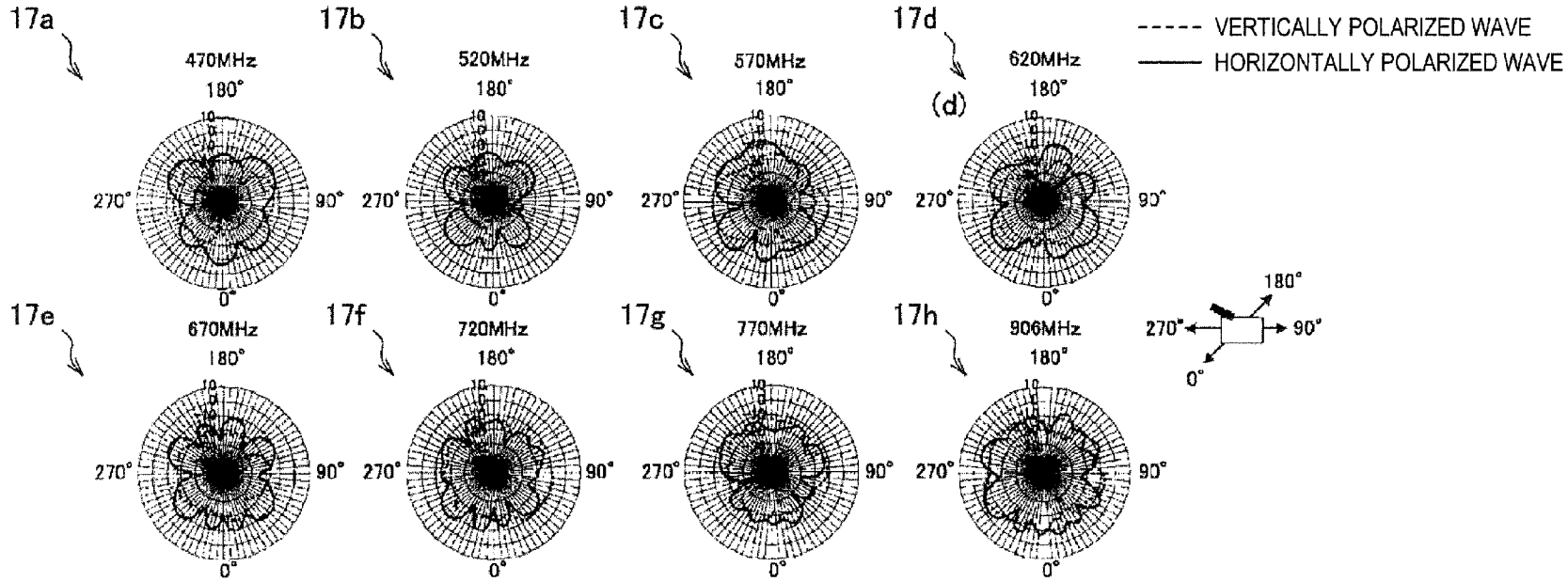
FIG. 17 is a graph and a table illustrating a measurement result of a peak gain and an average gain of the cable antenna in the UHF band according to the second embodiment of the invention.

Next, the directivity characteristics of the cable antenna 10 configured by the antenna shown in FIG. 10 will be described with reference to FIGS. 16 and 17. FIG. 16 is a diagram illustrating the directivity characteristics in the FM/VHF band. FIG. 17 is a diagram illustrating the directivity characteristics in the UHF band. In FIGS. 16 and 17, the directivity characteristics of the vertically polarized wave are indicated by a dashed line and the directivity characteristics of the horizontally polarized wave are indicated by a solid line.

First, the directivity characteristics of the cable antenna 10 in the FM/VHF band will be described with reference to FIG. 16. Part 16*a* shows a radiation pattern when the frequency is 76 MHz. Part 16*b* shows a radiation pattern when the frequency is 78.5 MHz. Part 16*c* shows a radiation pattern when the frequency is 81 MHz. Part 16*d* shows a radiation pattern when the frequency is 83.5 MHz. Part 16*e* shows a radiation pattern when the frequency is 86 MHz. Part 16*f* shows a radiation pattern when the frequency is 95 MHz. Part 16*g* shows a radiation pattern when the frequency is 101 MHz. Part 16*h* shows a radiation pattern when the frequency is 107 MHz. Part 16*i* shows the values of the peak gain (dBd) and the average gain (dBd) in the vertically polarized waves shown in parts 16*a* to 16*h*. Part 16*j* shows the values of the peak gain (dBd) and the average gain (dBd) in the horizontally polarized waves shown parts 16*a* to 16*h*.

The frequency of the FM/VHF band is a frequency at which the first antenna length including the folded portion resonates. As shown in parts 16*a* to 16*h*, it can be understood that the directivity characteristics are circular on a vertical plane, and are formed in a complete 8 shape in the horizontal direction.

Next, the directivity characteristics of the cable antenna 10 in the UHF band will be described with reference to FIG. 17. Part 17*a* shows a radiation pattern when the frequency is 470 MHz. Part 17*b* shows a radiation pattern when the frequency is 520 MHz. Part 17*c* shows a radiation pattern when the frequency is 570 MHz. Part 17*d* shows a radiation pattern when the frequency is 620 MHz. Part 17*e* shows a radiation pattern when the frequency is 670 MHz. Part 17*f* shows a radiation pattern when the frequency is 720 MHz. Part 17*g* shows a radiation pattern when the frequency is 770 MHz. Part 17*h* shows a radiation pattern when the frequency is 906 MHz. Part 17*i* shows the values of the peak gain (dBd) and the average gain (dBd) in the vertically polarized waves shown in parts 17*a* to 17*h*. Part 17*j* shows the values of the peak gain (dBd) and the average gain (dBd) in the horizontally polarized waves shown parts 17*a* to 17*h*.

The frequency of the UHF band is a frequency at which the second antenna length including no folded portion resonates (actually, it is possible for a portion received as a high-frequency of the resonant frequency for the first antenna length to be included, but this possibility is not considered in the following description). As shown in parts 17*a* to 17*h*, it can be understood that an angle at which no gain can be obtained is different between the vertically polarized wave and the horizontally polarized wave. That is, the gain in the horizontally polarized wave is high at an angle at which the gain in the vertically polarized wave is small. On the other hand, the gain in the vertically polarized wave is high at an angle at which the gain in the horizontally polarized wave is small. Thus, the horizontally polarized wave can be obtained at the angle at which the vertically polarized wave may not be obtained and the vertically polarized wave can be obtained at the angle at which the horizontally polarized wave may not be obtained. Accordingly, relatively satisfactory reception characteristics can be obtained even when the cable antenna 10 is used in an indoor place where the radio wave is reflected from a building or the like and the direction of the polarized wave is changed.

The directivity characteristics shown in the examples of FIGS. 16 and 17 can be obtained even in the cable antenna 10 of the first embodiment.

Advantageous Effects of Second Embodiment

In the above-described embodiment, even when the cable antenna 10 is configured without use of a high-frequency blocking member, the first antenna length or the second antenna length is configured by the cable length corresponding to the first line length in accordance with the magnitude of the frequency and resonates at another frequency. That is, it is possible to obtain the same advantage as in the first embodiment.

<4. Various Modifications of First and Second Embodiments>

(1) Modification 1 (Application Example of Antenna Receiving Other Frequency Bands)

In the above-described embodiment, the case in which the antenna is extracted from a receiver to receive the VHF band or the UHF band which is the frequency for the television broadcast has been assumed, but the invention is not limited thereto. For example, an antenna or the like of a GPS receiving a 1.575 GHz band may be configured by the configuration of the same coaxial wire. In this case, the length of a portion (antenna element portion) serving as an antenna may be set to 2.38 cm and the length of a portion (coaxial wire portion) serving as a GND may be set to 4.75 cm or more. Further, the antenna is applicable to an antenna of a wireless LAN. For example, when an antenna receiving, for example, a 2.4 GHz band is configured, the length of the antenna element portion may be set to 1.6 cm and the length of the coaxial wire portion may be set to 3.1 cm or more.

Figure 18A:
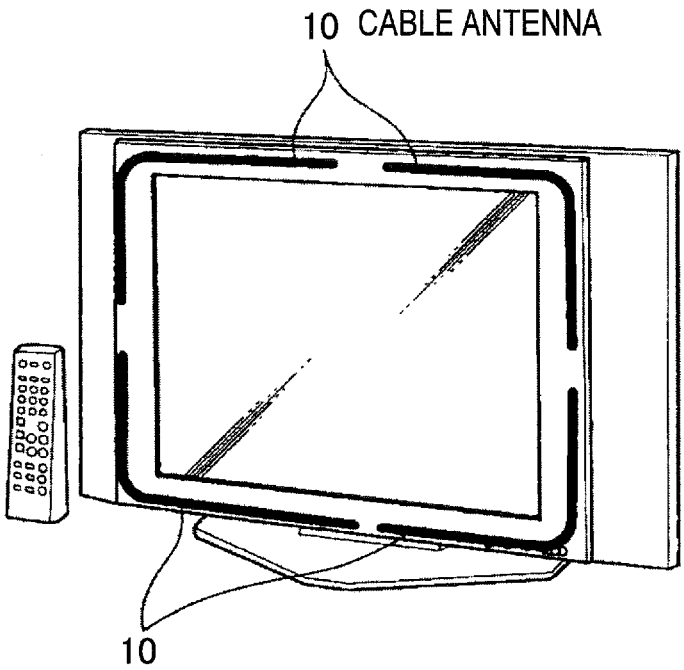
FIG. 18A is a diagram illustrating an example in which a cable antenna is embedded into the body of an apparatus according to Modification 1 of the invention.
Figure 18B:
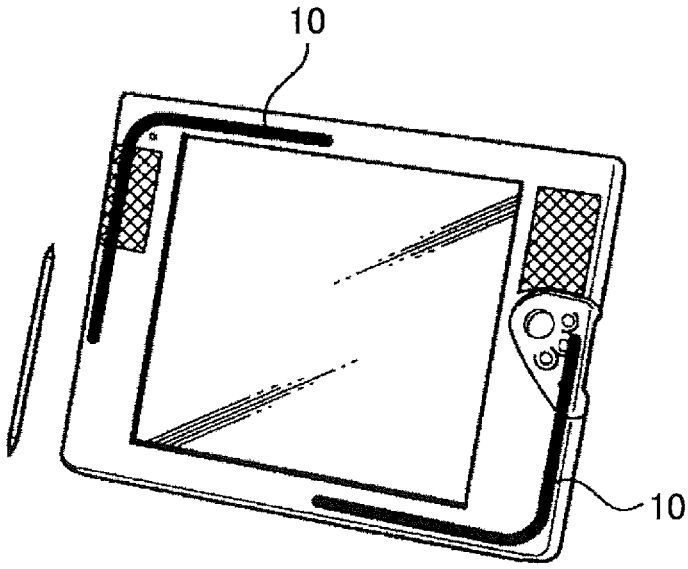
FIG. 18B is a diagram illustrating an example in which the cable antenna is embedded into the body of an apparatus according to Modification 1 of the invention.

Further, the antenna with the above-described configuration may be embedded into the body of a portable receiver (set) such as notebook-type PC. FIG. 18 is a diagram illustrating an example of the configuration when the cable antenna 10 is embedded. FIG. 18A shows an example in which the cable antenna is embedded into a television receiver. FIG. 18B shows an example in which the cable antenna is embedded into a portable terminal. In FIGS. 18A and 18B, the cable antenna 10 is indicated by a solid line. In this way, a dipole antenna is formed by mounting the cable antenna 10 so as to surround the periphery of a screen. That is, a parallel antenna dependent on no ground of the set is formed. Accordingly, it is possible to form the antenna which is easily adjusted and is very resistant to noise from an apparatus. The cable antenna 10 can be embedded into apparatuses such as television receivers, monitors of personal computers, portable media players, or tablet-type portable terminals.

(2) Modification 2 (Application Example of Antenna Mounted on Portable Terminal)

Figure 19:
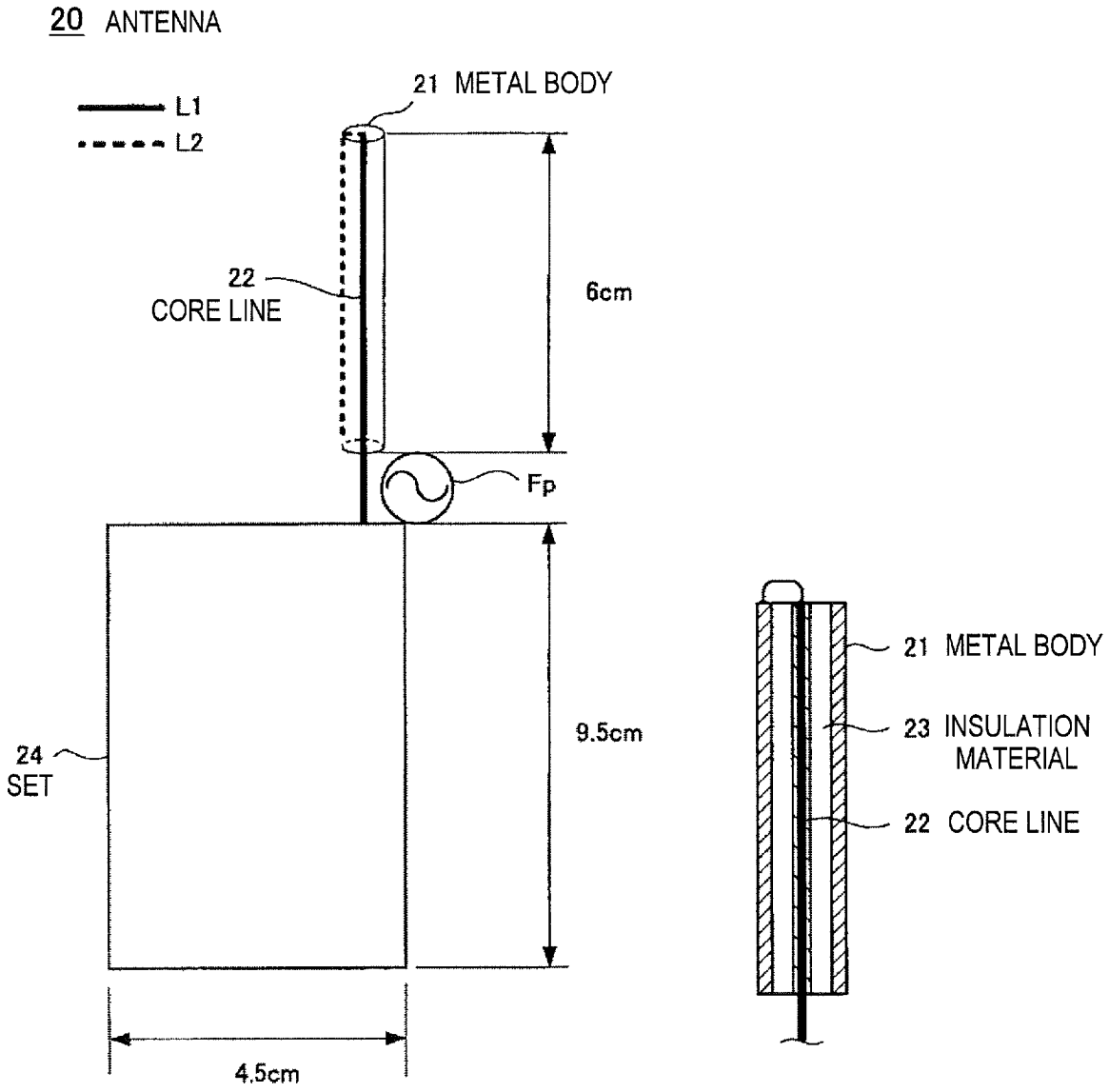
FIG. 19 is a diagram illustrating an example of the configuration of an antenna mounted on a portable terminal according to Modification 2 of the invention.

FIG. 19 is a diagram illustrating an example of the configuration of an antenna when the antenna according to the above-described embodiments is mounted on a portable terminal such as a cellular phone terminal. The left drawing of FIG. 19 is a perspective view illustrating a portion serving as an antenna element and the right drawing of FIG. 19 is a sectional view illustrating the portion. As shown in the left drawing of FIG. 19, the portion serving as the antenna element of an antenna 20 is formed by a tubular metal body 21. A core line 22 passes through the center of the portion. The core line 22 is connected to a set 24 and the front end portion of the core line 22 is connected to the metal body 21 in a folded manner. As shown in the right drawing of FIG. 19, a space between the core line 22 and the tubular metal body 21 is filled with an insulation material 23. As shown in the left drawing of FIG. 19, a portion in which the core line 22 is exposed between the set 24 and the metal body 21 becomes a feeding point Fp by forming a gap between the metal body 21 and the set 24 without contact between the metal body 21 and the set 24. With such a configuration, a first line length L1 from the feeding point Fp to the front end portion is formed as an antenna length and a second line length L2 from the folded portion of the front end portion to the end of the metal body 21 on the side of the feeding point Fp is formed as an antenna length so as to receive radio waves. In this example, the set 24 is configured as a substrate in which a ground pattern is formed on the entire surface. The set 24 has a vertical size of 9.5 cm and a horizontal size of 4.5 cm. Further, the length of the tubular metal body 21 is set to 6 cm.

Figure 20:
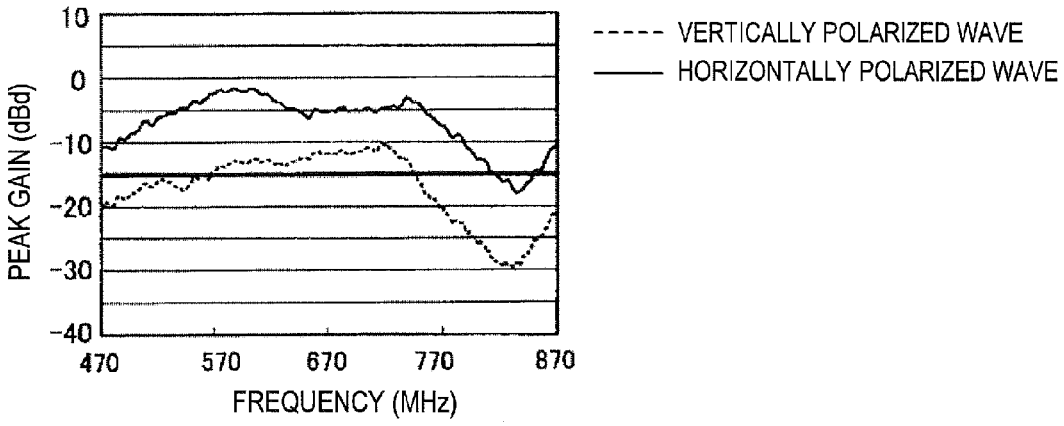
FIG. 20 is a graph and a table illustrating a measurement result of a peak gain of the antenna mounted on the portable terminal in the UHF band according to Modification 2 of the invention.

The upper drawing of FIG. 20 is a graph illustrating the peak gains of the antenna 20 shown in FIG. 19 in a vertically polarized wave and a horizontally polarized wave. The horizontal axis represents a frequency (MHz) and the vertical axis represents a peak gain (dBd). The frequency band of a measurement target is UHF. The vertically polarized wave is indicated by a dashed line and the horizontally polarized wave is indicated by a solid line. The intermediate drawing of FIG. 20 and the lower drawing of FIG. 20 show the values of the measurement points of the graphs shown in the upper drawing of FIG. 20. The intermediate drawing of FIG. 20 shows the value of the peak gain in the vertically polarized wave. The lower drawing of FIG. 20 shows the value of the peak gain in the horizontally polarized wave.

As shown in the upper drawing of FIG. 20 and the intermediate drawing of FIG. 20, the peak gain in the vertically polarized wave is −14.95 dBd at 570 MHz and −10.40 dBd at 720 MHz. As shown in the upper drawing of FIG. 20 and the intermediate drawing of FIG. 20, the peak gain in the horizontally polarized wave is −2.55 dBd at 570 MHz and −4.75 dBd at 720 MHz. That is, it can be understood that the cable antenna 20 shown in FIG. 19 receives both the vertically polarized wave and the horizontally polarized wave in the UHF band by the resonance near these frequencies.

Originally, the antenna length has to be set to about 12 cm, when the antenna receiving the UHF band is configured. Therefore, abundant cellular phone terminals corresponding to, for example, One Seg. employ an expandable rod antenna. However, the antenna of this example can receive the frequency (in this example, the UHF band) to be received, even when the antenna has half of the required antenna length. That is, the usability by a user can be improved, since the rod antenna used by expanding the front end portion of the antenna need not be employed.

(3) Modification 3 (Application Example of Dipole Antenna)

Figure 21:
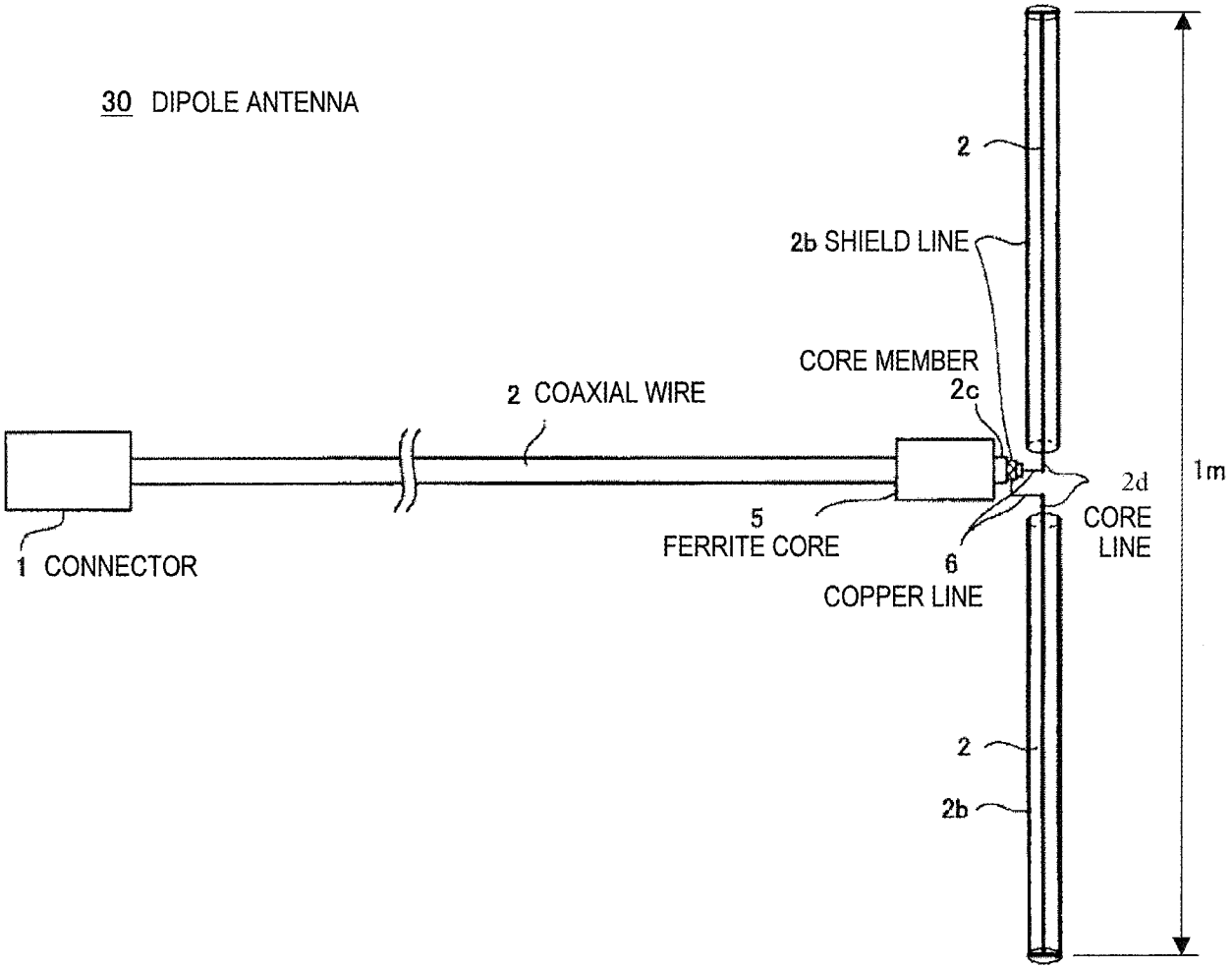
FIG. 21 is a diagram illustrating an example of the configuration of a dipole antenna according to Modification 3 of the invention.

FIG. 21 is a diagram illustrating an example of the configuration of an antenna when the antenna according to the above-described embodiments is applied to a dipole antenna. In a dipole antenna 30, a ferrite core 5 serving as a high-frequency attenuation member is inserted into the front end portion of the other end of a coaxial wire 2 connected to a connector 1. In the front portion of the ferrite core 5, a core line 2*d* and a shield line 2*b* of the coaxial wire 2 are extracted as copper lines 6. The copper lines 6 are connected to the core lines 2*d* of the two coaxial wires 2 opened in opposite directions (in the drawing, upward and downward directions), respectively. In the front end portions of the two coaxial wires 2, the core line 2*d* is connected to the shield line 2*b*. In the base portion of the coaxial wire 2, the protective coat and the shield line 2*b* are removed to expose the core member 2*c* and the core line 2*d*. Thus, the base portion serves as a feeding point Fp and the two coaxial wires 2 serve as antenna elements. In FIG. 21, the portions serving as the antenna elements are indicated by folded solid lines. The lengths of the antenna elements are set to a total of 1 m.

Figure 22:
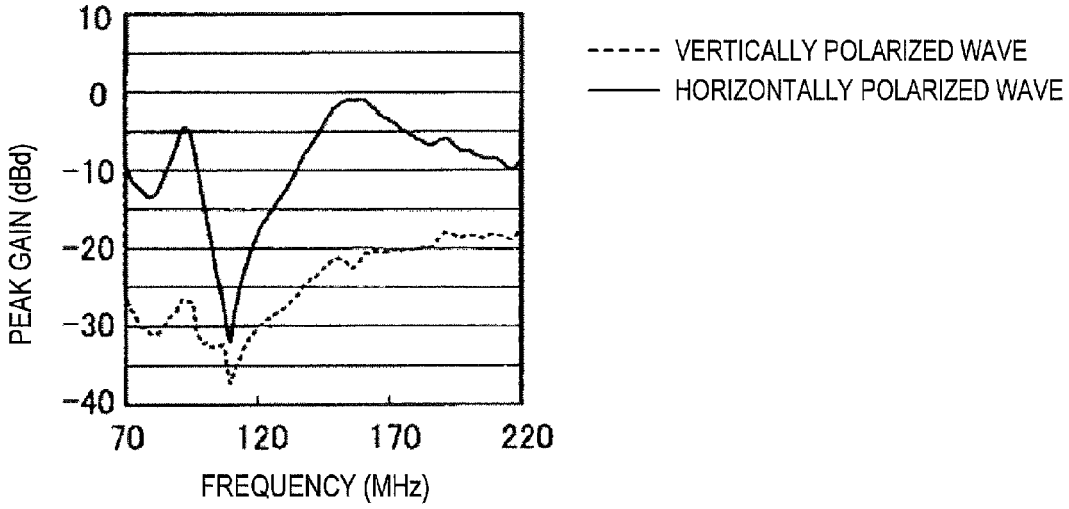
FIG. 22 is a graph and a table illustrating a measurement result of a peak gain of the dipole antenna in the FM/VHF band according to Modification 3 of the invention.

The upper drawing of FIG. 22 is a graph illustrating the peak gains of the dipole antenna 30 shown in FIG. 21 in the vertically polarized wave and the horizontally polarized wave. The horizontal axis represents a frequency (MHz) and the vertical axis represents a peak gain (dBd). The frequency band of a measurement target is FM/VHF. The vertically polarized wave is indicated by a dashed line and the horizontally polarized wave is indicated by a solid line. The intermediate drawing of FIG. 22 and the lower drawing of FIG. 22 show the values of the measurement points of the graphs shown in the upper drawing of FIG. 22. The intermediate drawing of FIG. 22 shows the value of the peak gain in the vertically polarized wave. The lower drawing of FIG. 22 shows the value of the peak gain in the horizontally polarized wave. Further, the intermediate drawing of FIG. 22 and the lower drawing of FIG. 22 show only the measured values in the frequencies between 76 MHz and 107 MHz among the frequencies represented by the horizontal axis of the upper drawing of FIG. 22.

As shown in the upper and lower drawings of FIG. 22, the peak gain in the abundant bands is −15 dB or less particularly in the horizontally polarized wave. Further, it can be understood that resonance can be obtained at two frequencies: near 155 MHz and near 95 MHz. Originally, the antenna length has to be set to about 2 m when the antenna receiving the FM/VHF band is configured. However, the dipole antenna of this example can receive the FM/VHF band with a length of 1 m which is half of the required length. Further, not only the frequency originally desired to be received but also a frequency lower than this frequency can be received with half of the antenna length calculated from the wavelength of a radio wave desired to be received.

(4) Modification 4 (Example where Plurality of Folded Structures are Provided)

In the above-described embodiments, the example in which the "folded structure" in which the core line 2*d* is connected to the shield line 2*b* in the front end portion of the coaxial wire 2 is formed at one location has been described. However, the "folded structure" may be formed at a plurality of locations. Thus, one antenna can receive the radio waves of more frequency bands. First, a principle of multi-resonance of an antenna having the plurality of folded structures will be described with reference to FIGS. 23 to 25. Then, the verification data will be described with reference to FIGS. 26 to 31.

Figure 23:
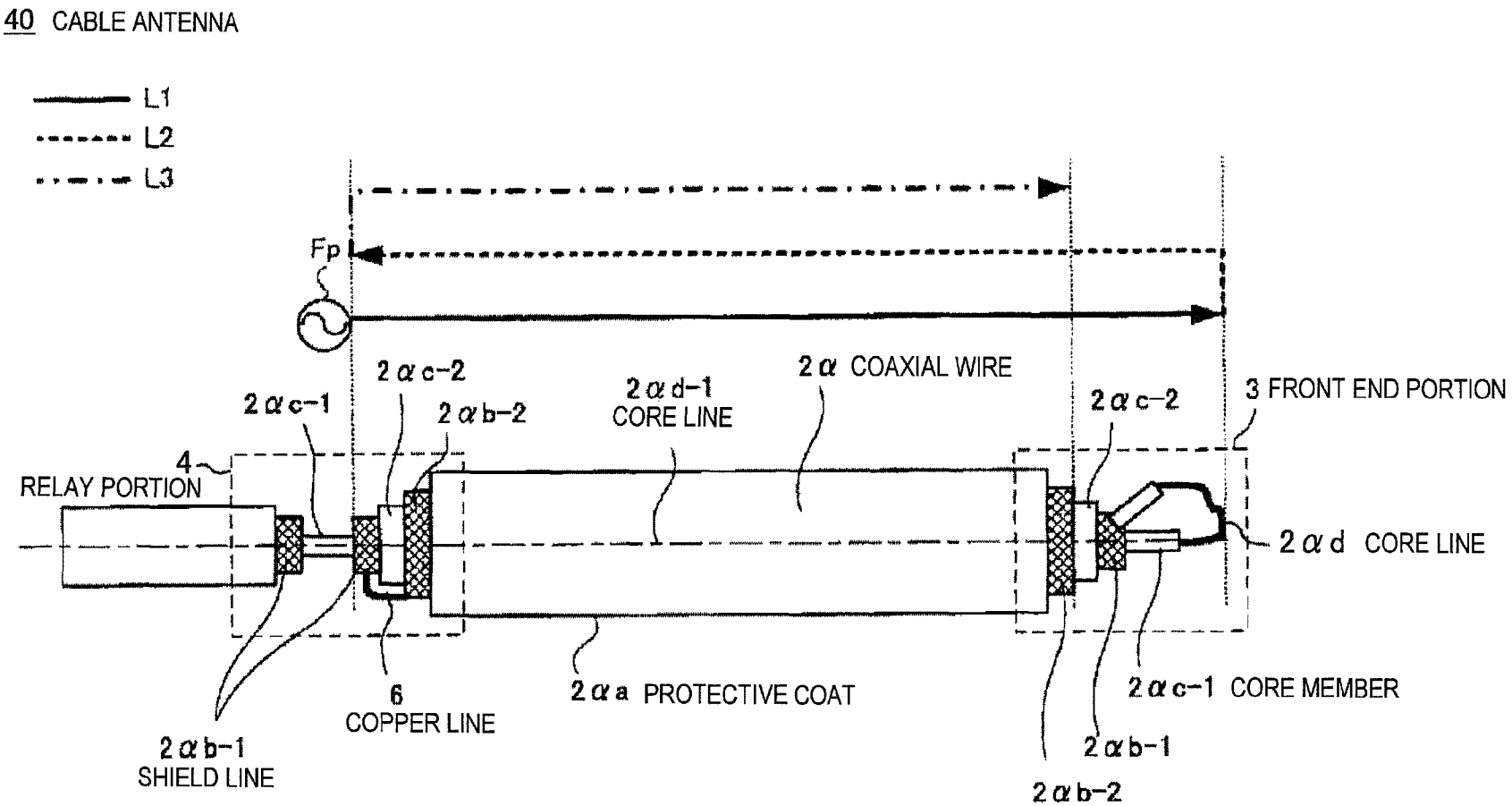
FIG. 23 is a diagram illustrating an example of the configuration of a cable antenna according to Modification 4 of the invention.

FIG. 23 is a diagram illustrating an example of the configuration of an antenna 40 in which two folded structures are formed. A cable antenna 40 shown in FIG. 23 is formed only by a coaxial wire 2*a*. However, since two folded structures are formed, the coaxial wire 2*a* is configured to have two shield lines. That is, a core member 2*ac*-2 is formed outside a shield line 2*ab*-1 covering a core member 2*ac*-1 and a shield line 2*ab*-2 is wound outside the core member 2*ac*-2. The outside of the shield line 2*ab*-2 is covered with a protective coat 2*aa*. The core member 2*ac*-1 covering a core line 2*ad*-1 is exposed in a front end portion (front end portion 3) of the coaxial wire 2*a* shown in the right part of FIG. 22 and at a position (relay portion 4) distant by a predetermined length from the front end portion toward the other end. The exposed portions are molded by a resin such as elastomer.

The core line 2*ad* is connected to the inner shield line 2*ab*-1 inside the molded front end portion 3. In the relay portion 4, the inner shield line 2*ab*-1 and the outer shield line 2*ab*-2 are connected by a copper line 6. That is, the folded structures are formed at two locations of the print end portion of the coaxial wire 2*a* and the position distant by the predetermined length from the front end portion toward the other end.

Thus, a first line length L1, which is a line length from the relay portion 4 serving as a feeding point Fp to the folded point of the front end portion 3, is a second antenna length, so that the cable antenna with the second antenna length receives a radio wave with a resonant frequency f1 (wavelength: λ10). Further, a length which is a sum of a first line length L1 and the second line length L2 which is the line length from the folded point of the front end portion to the feeding point Fp is a first antenna length, so that the cable antenna with the first antenna length receives a radio wave with a resonant frequency f2 (wavelength: λ10×2). Further, a length which is a sum of the first line length L1, the second line length L2, and a third line length L3 which is a line length from the feeding point Fp to the end of the shield line 2*ab*-2 is a third antenna length, so that the cable antenna with the first antenna length receives a radio wave with a resonant frequency f3 (wavelength: λ10×3). That is, the magnitudes of the frequencies received by the cable antenna 40 shown in FIG. 23 have a relation of "a resonant frequency f1>a resonant frequency f2>a resonant frequency f3."

In FIG. 23, the case in which two folded structures are formed has been described. However, more folded structures such as three or four folded structures may be formed. By forming more folded structures, the radio waves with more frequency bands can be received.

Figure 24:
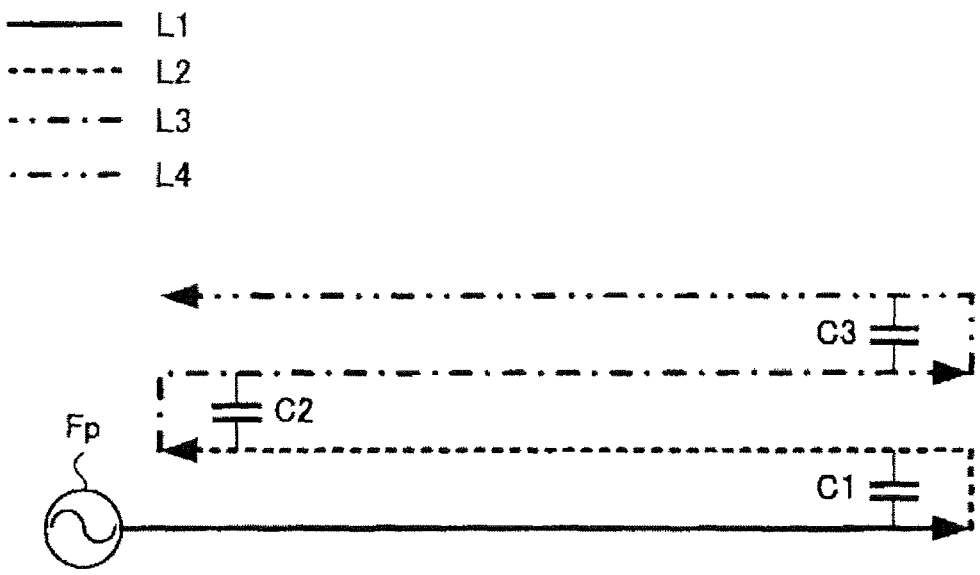
FIG. 24 is a diagram illustrating the line lengths of the cable antenna according to Modification 4 of the invention.

The principle in which the antenna with the plurality of folded structures resonate with the radio waves in a plurality of different frequency bands will be described with reference to FIG. 24. In FIG. 24, a solid line indicates a portion serving as an antenna element of the antenna with the plurality of folded structures. In FIG. 24, for example, three folded structures are formed to facilitate the description.

In each portion of the folded structure, as described above, impedance connection is equivalently present between the start point and the folded point. In FIG. 24, an electrostatic capacitance portion is formed in each impedance connection portion, that is, in each of the portions between the line lengths L1 and L2, between the line lengths L2 and L3, and between the line lengths L3 and L4. The electrostatic capacitances of the electrostatic capacitance portions are denoted by electrostatic capacitance C1, electrostatic capacitance C2, and electrostatic capacitance C3. Since the diameter of the coaxial wire 2*a* is larger from the core line 2*d* (toward the outer side in a radial direction), the volume of the core member (insulation member) between the core line and the shield line or between the shield lines increases. Therefore, the electrostatic capacitance of the impedance connection portion is larger from the center to the outer side of the coaxial wire 2*a*. That is, the magnitudes of the electrostatic capacitances C1 to C3 have a relation of "electrostatic capacitance C1<electrostatic capacitance C2<electrostatic capacitance C3."

Accordingly, when the resonant frequency f1 is higher through the electrostatic capacitance C1, the electrostatic capacitance portions with the electrostatic capacitances C2 and C3 appear to be short-circuited. Therefore, in the example of FIG. 23, a radio wave is received with the antenna length (the second antenna length) of only the first line length L1. When the resonant frequency f2 is slightly lower than the resonant frequency f1 and is a frequency of the extent that the electrostatic capacitance C3 appears to be short-circuited, a radio wave is received with the antenna length (first antenna length) of "the first line length L1+the second line length L2." In the case of the resonant frequency f3 lower than the resonant frequency f2, a radio wave is received with the antenna length (third antenna length) of "the first line length L1+the second line length L2+the third line length L3." Since the portions with different line lengths are formed in one coaxial wire 2*a* in accordance with the magnitude of the frequency, the cable antenna can receive the radio waves with a plurality of frequencies with different magnitudes.

Figure 25:
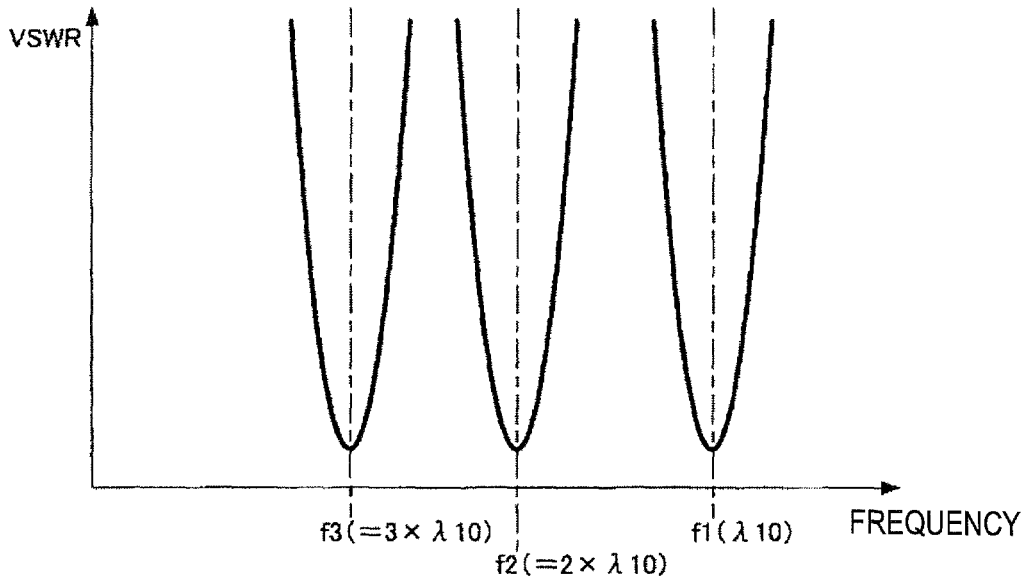
FIG. 25 is a diagram schematically illustrating the frequency bands of the radio waves received by the cable antenna according to Modification 4 of the invention.

FIG. 25 is a diagram schematically illustrating the frequency characteristics of the cable antenna 40. In FIG. 25, the horizontal axis represents a frequency (MHz) and the vertical axis represents VSWR. In the cable antenna 40, as shown in FIG. 25, in principle, it is possible to obtain resonance at three frequencies: the resonant frequency f1 with a wavelength λ10, the resonant frequency f2 with a wavelength which is twice the wavelength λ10, and the resonant frequency f3 with a wavelength which is three times the wavelength λ10.

To verify that this principle is right, the inventors and others manufactured an evaluation antenna and measured the VSWR. A dipole antenna was used as the evaluation antenna. Since the lengths of the right and left conductive lines were equal to each other in the dipole antenna, it was considered that more exact data can be obtained. As the evaluation dipole antennas, three kinds of antennas with no folded structure, one folded structure, and two folded structures were prepared. The evaluation antennas were manufactured with a coaxial wire 2 with an inter-line impedance is 50 Ω.

Figure 26:
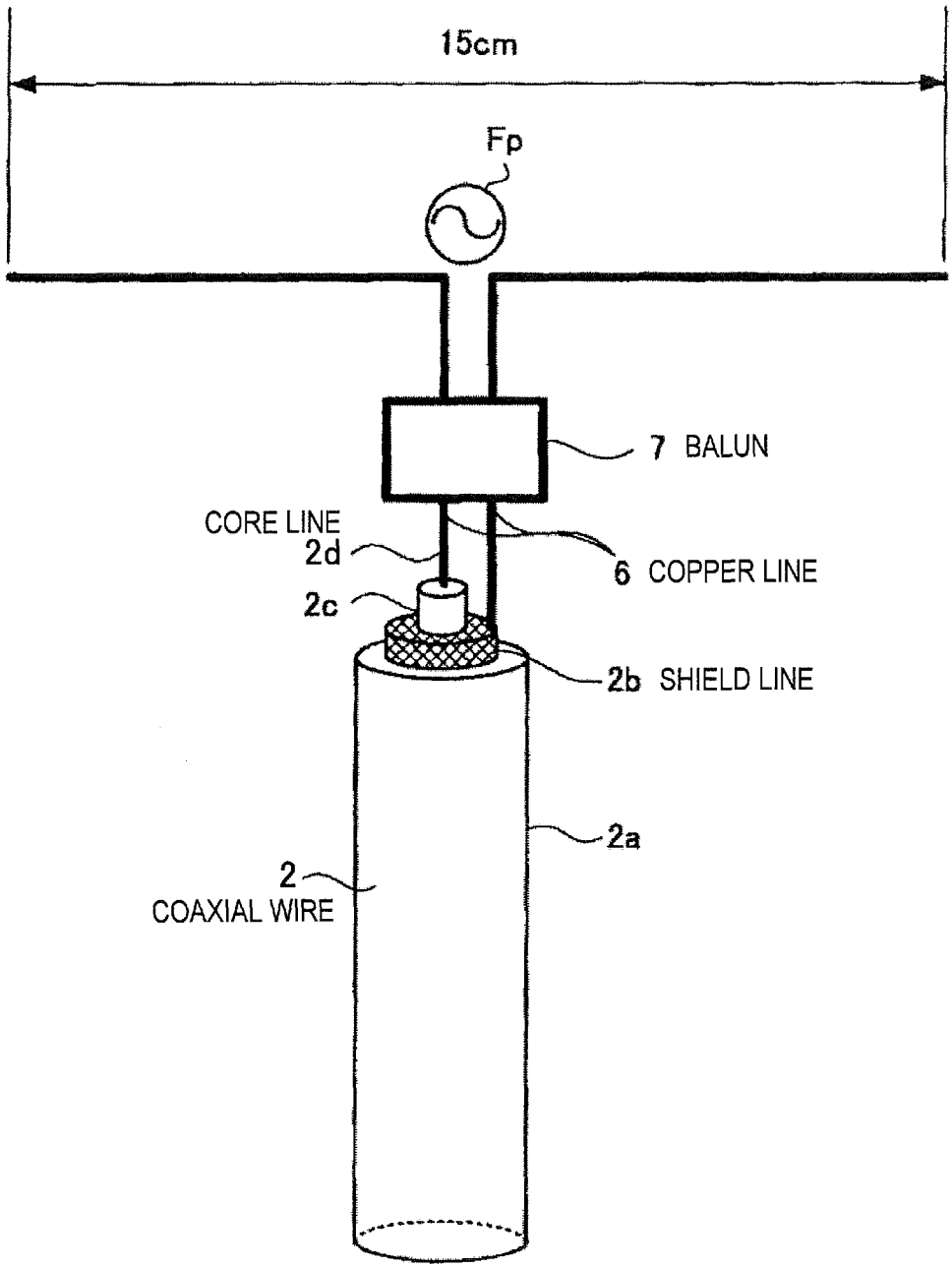
FIG. 26 is a diagram illustrating an example of the configuration of an evaluation dipole antenna (with no folded structure).
Figure 27:
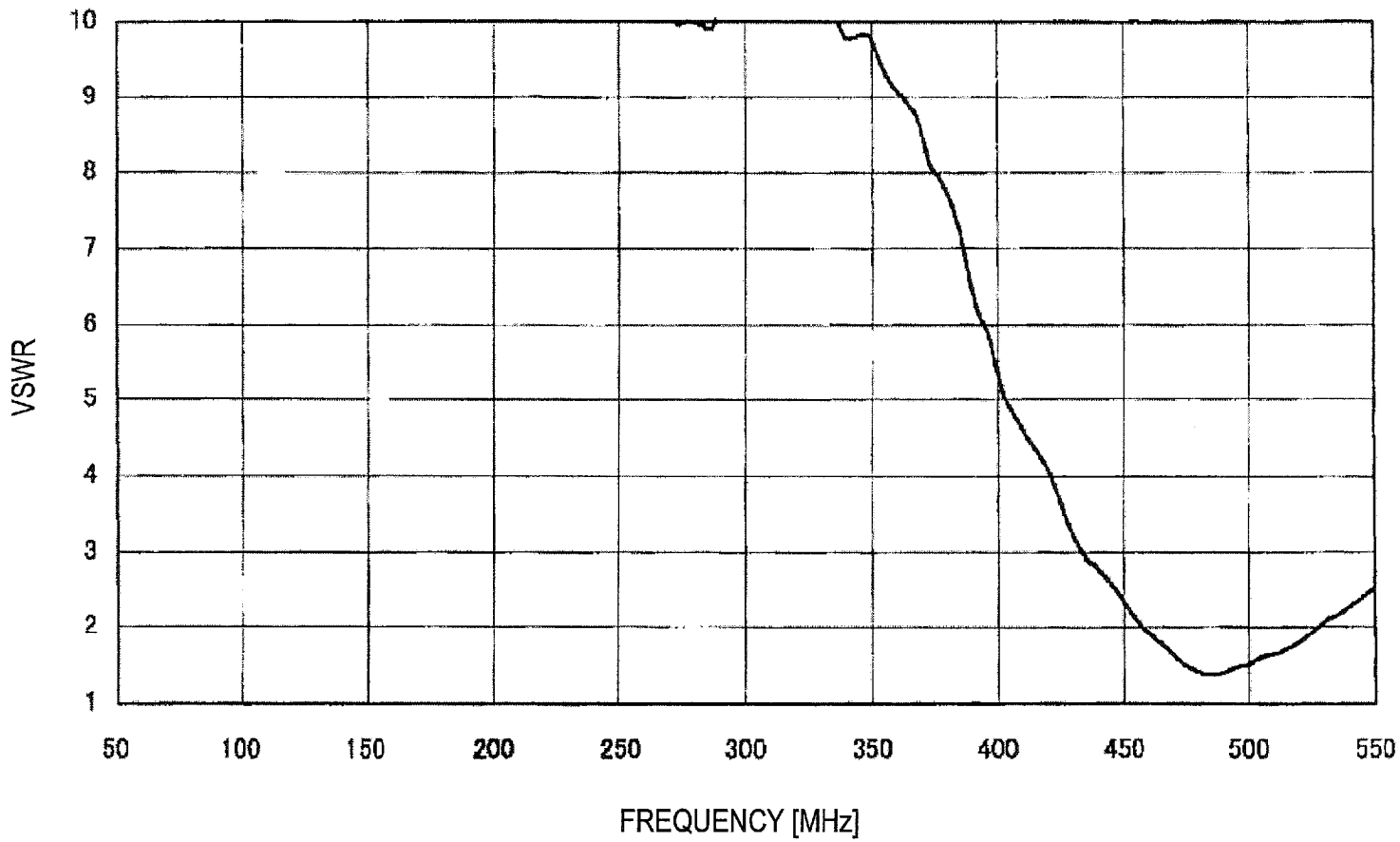
FIG. 27 is a graph illustrating VSWR characteristics of the evaluation dipole antenna (with no folded structure).

The evaluation dipole antenna shown in FIG. 26 has no folded structure. That is, the evaluation dipole antenna has the same configuration as a conventional dipole antenna. In FIG. 26, the same reference numerals are given to portions corresponding to the portions of FIG. 21 and the description will not be repeated. A core line 2*d* and a shield line 2*b* of the coaxial wire 2 are extracted as copper lines 6. The copper lines 6 are opened in the opposite direction. A balun 7 is inserted between coaxial wire 2 and the two copper lines 6 serving as an antenna element. A total of the lengths of the two copper lines 6 serving as the antenna element is set to 15 cm. FIG. 27 is a graph illustrating the antenna characteristics of the evaluation dipole antenna shown in FIG. 26. The horizontal axis represents a frequency (MHz) and the vertical axis represents VSWR. FIG. 27 shows resonance which can be obtained near 480 MHz close to the 500 MHz obtained by calculation.

Figure 28:
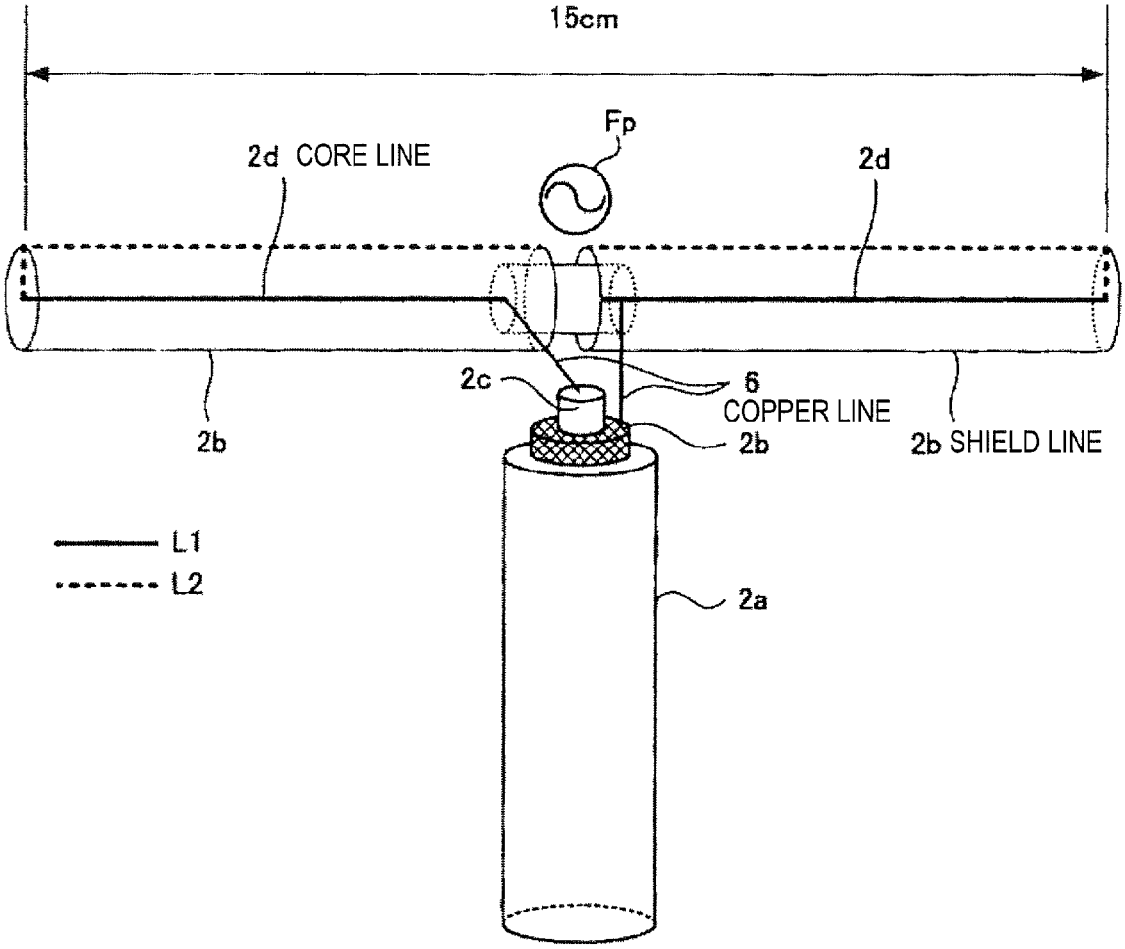
FIG. 28 is a diagram illustrating an example of the configuration of an evaluation dipole antenna (with one folded structure).
Figure 28:
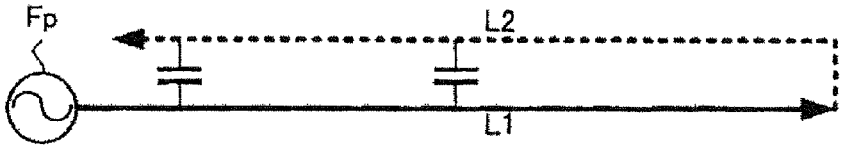

An evaluation dipole antenna shown in the upper drawing of FIG. 28 has one folded structure. In FIG. 28, the same reference numerals are given to portions corresponding to the portions of FIGS. 21 to 27 and the description thereof will not be repeated. As in the configuration shown in FIG. 21, the antenna element portion is configured by the coaxial wire 2, and the core line 2*d* and the shield line 2*b* are connected to each other in both front end portions. Thus, a first line length L1, which is indicated by a sold line and is a line length from a feeding point Fp to a folded point, and a second line length L2, which is indicated by a dashed line and is a line length from the folded point to the feeding point Fp, serve as an antenna element. Specifically, as shown in the lower drawing of FIG. 28, the first line length L1 resonates at the resonant frequency f1 and the length of the first line length L1 and the second line length L2 combined resonates at the resonant frequency f2.

Figure 29:
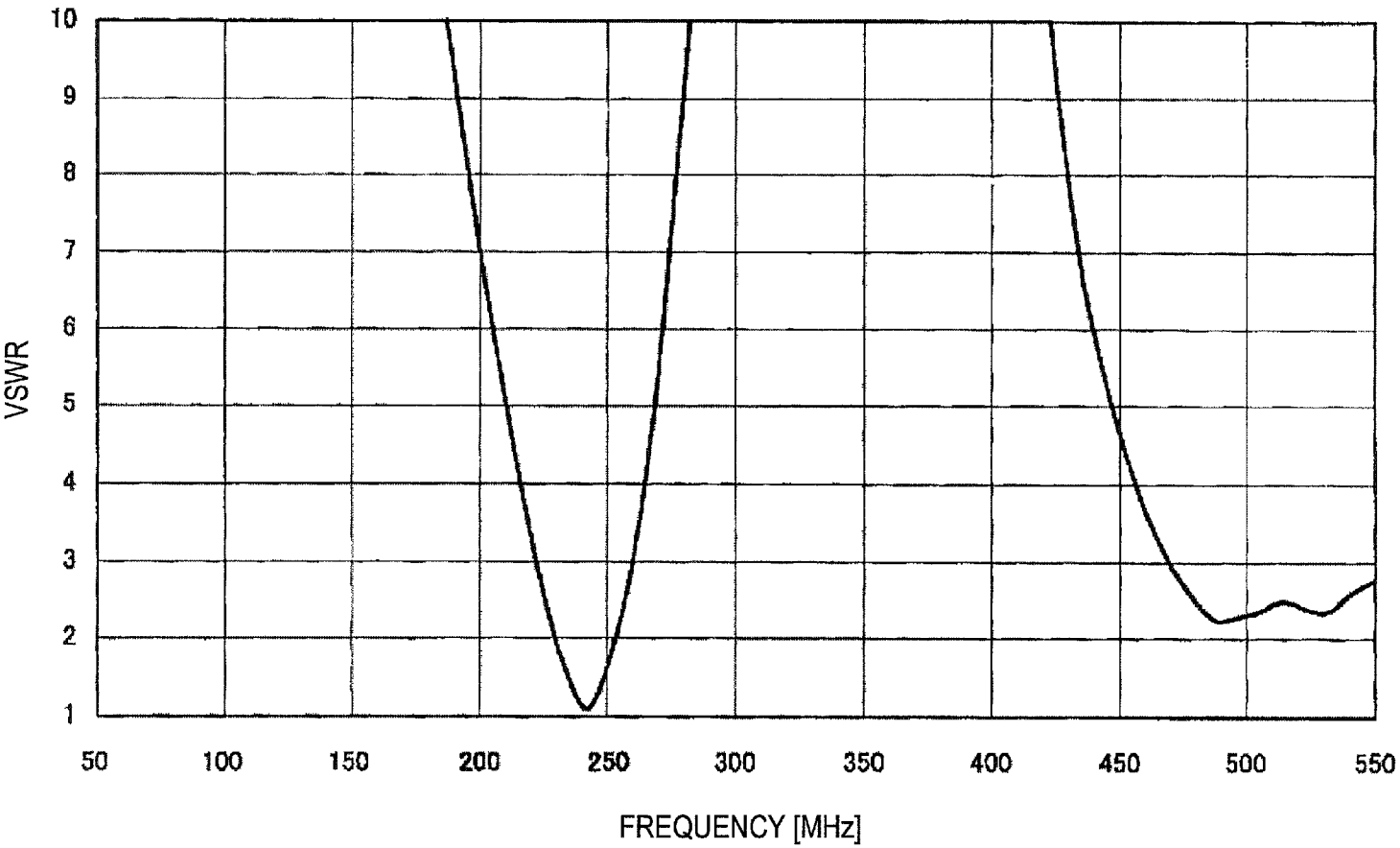
FIG. 29 is a graph illustrating VSWR characteristics of the evaluation dipole antenna (with one folded structure).

FIG. 29 is a graph illustrating the antenna characteristics of the evaluation dipole antenna shown in the upper drawing of FIG. 28. The horizontal axis represents a frequency (MHz) and the vertical axis represents VSWR. FIG. 29 shows not only the resonance which can be obtained near 450 MHz originally obtained with the antenna length of 15 cm but also the resonance which can be obtained near lower 240 MHz. That is, it can be understood that the first line length L1 shown in FIG. 28 resonates at a frequency (resonant frequency f1) near 450 MHz and the length of the first line length L1+the second line length L2 resonates at a frequency (resonant frequency f2) near 240 MHz.

Figure 30:
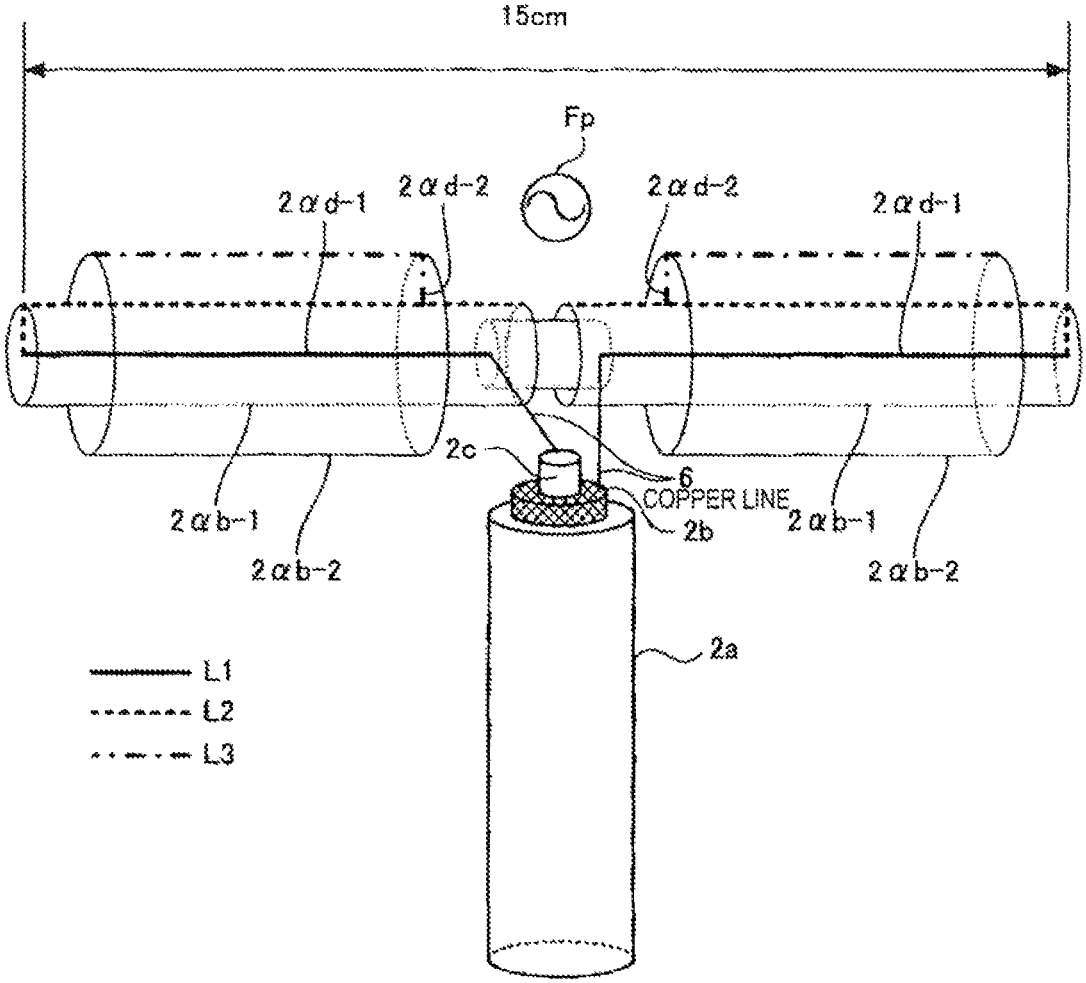
FIG. 30 is a diagram illustrating an example of the configuration of an evaluation dipole antenna (with two folded structures).
Figure 30:
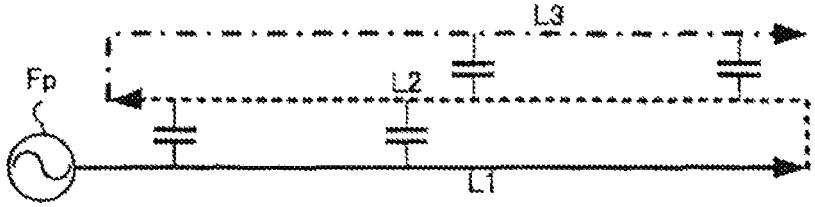

The evaluation dipole antenna shown in the upper drawing of FIG. 30 has two folded structures. In the upper drawing of FIG. 30, the same reference numerals are given to portions corresponding to the portions of FIG. 23 and the description thereof will not be repeated. As in the cable antenna 40 shown in FIG. 23, double shield lines are formed and the core line 2*ad*-1 is connected to the inner shield line 2*ab*-1 in the front end portion. In the feeding point Fp, the inner shield line 2*ab*-1 is connected to the outer shield line 2*ab*-2. That is, the folded structures are formed in two portions of the front end portions and the feeding point Fp of the coaxial wire 2*a*. Thus, since not only the first line length L1 indicated by the solid line and the second line length L2 indicated by the dashed line, but also the third line length L3 indicated by a one-dot chain line and serving as the line length from the feeding point Fp at the folded point to the front end portion, is an antenna length, the radio waves can be received. Specifically, as shown in the lower drawing of FIG. 30, the first line length L1 resonates at the resonant frequency f1, the length of the first line length L1 and the second line length L2 combined resonates at the resonant frequency f2, and the length of the first line length L1, the second line length L2, and the third line length L3 combined resonates at the resonant frequency f3.

Figure 31:
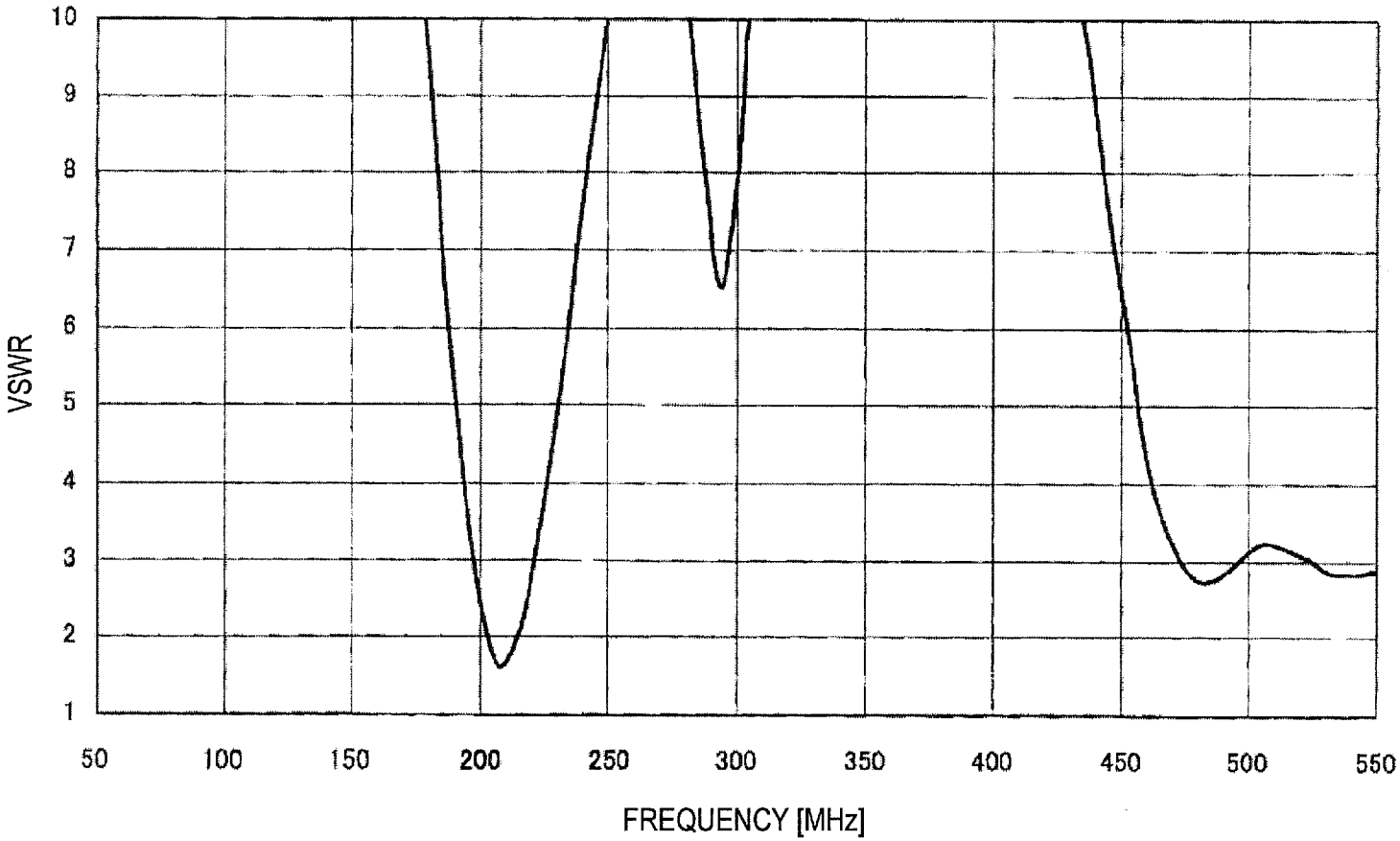
FIG. 31 is a graph illustrating VSWR characteristics of the evaluation dipole antenna (with two folded structures).

FIG. 31 is a graph illustrating the antenna characteristics of the evaluation dipole antenna shown in the upper drawing of FIG. 30. The horizontal axis represents a frequency (MHz) and the vertical axis represents VSWR. FIG. 31 shows not only the resonance which can be obtained near 450 MHz originally obtained with the antenna length of 15 cm but also the resonance which can be obtained near a lower 240 MHz and the resonance which can be obtained near an even lower 210 MHz. That is, it can be understood that the first line length L1 shown in FIG. 30 resonates at a frequency (resonant frequency f1) near 450 MHz and the length of the first line length L1+the second line length L2 resonates at a frequency (resonant frequency f2) near 240 MHz. Further, it can be understood that and the length of the first line length L1+the second line length L2+the third line length L3 resonates at a frequency (resonant frequency f3) near 210 MHz.

When the resonance can be obtained in principle by adjusting the dielectric constant of the dielectric of the coat of the antenna, the estimated resonant points and a closer resonant point can be obtained.

In the cable antenna 40 which is a modification of the antenna of the invention and has the plurality of folded structures, it is possible to receive the radio waves with a plurality of different frequency bands in accordance with the number of folded structures by the use of only one coaxial wire 2*a*.

Further, by forming the folded structure in the portions of the front end portion and/or the feeding point Fp of the antenna, it is possible to actually shorten the length of a portion serving as the antenna element. For example, when a radio wave of the FM band is received by an antenna of a ½ wavelength, the antenna length is required to be about 2 m. However, when the radio wave of the FM band is received with the line length of the first line length L1+the second line length L2+the third line length L3 by the cable antenna 40 having two folded structures, the antenna length can be shortened to about 67 cm which is ⅓ of the antenna length. For example, when the cable antenna 40 is applied to a multimedia broadcasting antenna by which an image is transmitted to cellular phone terminals by the use of the radio wave of the VHF band, an antenna can be configured to be miniaturized and receive the radio waves of a broader frequency band.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

REFERENCE SIGNS LIST

1 Connector
2 Coaxial wire
2*a*, 2*aa* Protective coat
2*b* Shield line
2*c* Core member
2*d* Core line
3 Front end portion
4 Relay portion
5 Ferrite core
6 Copper line
7 Balun
10 Cable antenna
20 Antenna
21 Metal body
22 Core line
23 Insulation material
24 Set
30 Dipole antenna
40 Antenna
C1 to C3 Electrostatic capacitance
Fp Feeding point
L1 First line length
L2 Second line length
L3 Third line length
L11 Line length
f1 to f3 Resonant frequency

The invention claimed is:

1. An antenna comprising:

a first conductor that has a first line length from a start point to a folded point; and a second conductor that has a second line length in a direction from the folded point to the start point and is electrically connected to the first conductor at the folded point, wherein a first received signal with a first frequency is received by a conductor with a first antenna length corresponding to a length obtained by combining the first line length and the second line length, a second received signal with a second frequency is received by a conductor with a second antenna length corresponding to one of the first line length and the second line length, and one of the first and second conductors is a core line of a coaxial wire and the other thereof is an external conductor of the coaxial wire.

2. The antenna according to claim 1, wherein impedance connection in which an impedance value of the first frequency is different from an impedance value of the second frequency is equivalently present between a vicinity of an end of one of the first and second conductors on the side of the start point and the other thereof.

3. The antenna according to claim 2, wherein the impedance connection is high-frequency capacitive coupling.

4. The antenna according to claim 1, wherein, at the start point, a protective coat and the external conductor of the coaxial wire are removed.

5. The antenna according to claim 1, wherein the first line length is λ/4 to 3λ/ of a wavelength of the second frequency.

6. The antenna according to claim 1, wherein a high-frequency attenuation member attenuating high-frequency current is disposed at a position corresponding to a length equal to or greater than the first line length from the start point in a direction opposite to a direction in which the folded point is present.

7. The antenna according to claim 1, further comprising:

a third conductor that is electrically connected to the second conductor at the start point and has a third line length from the start point in a direction of the folded point, wherein a third received signal with a third frequency is received by a conductor with a third antenna length corresponding to a length of the first, second, and third line lengths combined.

8. The antenna according to claim 7, wherein impedance connection in which impedance values of the first, second, and third frequencies are different from each other is present between a vicinity of an end of one of the first and second conductors on the side of the start point and the other thereof and between a vicinity of an end of one of the second and third conductors on the side of the start point and the other thereof, and a magnitude of an electrostatic capacitance of an impedance connection portion present between the vicinity of the end of one of the first and second conductors on the side of the start point and the other thereof is less than a magnitude of an electrostatic capacitance of an impedance connection portion present between the vicinity of the end of one of the second and third conductors on the side of the start point and the other thereof.

* * * * *